US008874437B2

(12) United States Patent
Sukkar et al.

(10) Patent No.: US 8,874,437 B2
(45) **Date of Patent: *Oct. 28, 2014**

(54) METHOD AND APPARATUS FOR MODIFYING AN ENCODED SIGNAL FOR VOICE QUALITY ENHANCEMENT

(75) Inventors: Rafid A. Sukkar, Aurora, IL (US); Richard C. Younce, Yorkville, IL (US); Peng Zhang, Buffalo Grove, IL (US)

(73) Assignee: Tellabs Operations, Inc., Naperville, IL (US)

( * ) Notice: Subject to any disclaimer, the term of this patent is extended or adjusted under 35 U.S.C. 154(b) by 299 days.

This patent is subject to a terminal disclaimer.

(21) Appl. No.: 11/165,599

(22) Filed: Jun. 22, 2005

(65) Prior Publication Data

US 2006/0217974 A1 Sep. 28, 2006

Related U.S. Application Data

(60) Provisional application No. 60/665,910, filed on Mar. 28, 2005, provisional application No. 60/665,911, filed on Mar. 28, 2005.

(51) Int. Cl.
*G10L 21/00* (2013.01)
*G10L 19/083* (2013.01)

(52) U.S. Cl.
CPC ..... *G10L 21/02025* (2013.01); *G10L 19/083* (2013.01)
USPC ..... 704/225; 704/219; 704/230; 704/500; 704/502; 704/503

(58) Field of Classification Search
USPC ..... 704/219, 225, 230
See application file for complete search history.

(56) References Cited

U.S. PATENT DOCUMENTS 5,835,486 A 11/1998 Davis et al.
5,835,851 A 11/1998 Rasmusson et al.

(Continued)

FOREIGN PATENT DOCUMENTS

EP 1 301 018 A1 4/2003
EP 1 432 222 A1 6/2004

(Continued)

OTHER PUBLICATIONS

Taddei, H., et al., "Noise Reduction on Speech Codec Parameters," *IEEE*, pp. 497-500 (2004).

(Continued)

*Primary Examiner* — Leonard Saint Cyr
(74) *Attorney, Agent, or Firm* — Hamilton, Brook, Smith & Reynolds, P.C.

(57) ABSTRACT

Adaptive Gain Control (AGC) is performed directly in a coded domain. A Coded Domain Adaptive Gain Control (CD-AGC) system modifies at least one parameter of a first encoded signal, resulting in corresponding modified parameter(s). The CD-VQE system replaces the parameter(s) of the first encoded signal with the modified parameter(s), resulting in a second encoded signal. In a decoded state, the second encoded signal approximates a target signal that is a function of two signals, including the first encoded signal and a third encoded signal, in at least a partially decoded states. Thus, the first encoded signal does not have to go through intermediate decode/re-encode processes, which can degrade overall speech quality. Computational resources required for a complete re-encoding are not needed. Overall delay of the system is minimized. The CD-AGC system can be used in any network in which signals are communicated in a coded domain, such as a Third Generation (3G) wireless network.

44 Claims, 32 Drawing Sheets

(56) References Cited

U.S. PATENT DOCUMENTS

| | | | | |
|---|---|---|---|---|
| 6,122,611 | A | 9/2000 | Su et al. | |
| 6,424,938 | B1 | 7/2002 | Johansson et al. | |
| 6,504,838 | B1 * | 1/2003 | Kwan | 370/352 |
| 6,625,284 | B1 | 9/2003 | Ariyama | |
| 6,633,842 | B1 | 10/2003 | Gong | |
| 6,765,931 | B1 * | 7/2004 | Rabenko et al. | 370/493 |
| 6,804,350 | B1 * | 10/2004 | Siqueira | 379/406.01 |
| 6,850,577 | B2 * | 2/2005 | Li | 375/326 |
| 6,980,528 | B1 | 12/2005 | LeBlanc et al. | |
| 7,010,118 | B2 | 3/2006 | Etter | |
| 7,124,079 | B1 | 10/2006 | Johansson et al. | |
| 2001/0006511 | A1 | 7/2001 | Matt | |
| 2002/0184010 | A1 * | 12/2002 | Eriksson et al. | 704/219 |
| 2003/0065507 | A1 * | 4/2003 | Gerlach | 704/212 |
| 2003/0093270 | A1 | 5/2003 | Domer | |
| 2004/0076271 | A1 | 4/2004 | Koistinen et al. | |
| 2004/0243404 | A1 | 12/2004 | Cezanne et al. | |
| 2005/0018798 | A1 | 1/2005 | Li | |
| 2005/0137864 | A1 | 6/2005 | Valve et al. | |
| 2005/0234714 | A1 | 10/2005 | Takagi et al. | |
| 2006/0215683 | A1 | 9/2006 | Sukkar et al. | |
| 2006/0217969 | A1 | 9/2006 | Sukkar et al. | |
| 2006/0217970 | A1 | 9/2006 | Sukkar et al. | |
| 2006/0217971 | A1 | 9/2006 | Sukkar et al. | |
| 2006/0217972 | A1 | 9/2006 | Sukkar et al. | |
| 2006/0217974 | A1 | 9/2006 | Sukkar et al. | |
| 2006/0217983 | A1 | 9/2006 | Sukkar et al. | |
| 2006/0217988 | A1 | 9/2006 | Sukkar et al. | |
| 2007/0025480 | A1 | 2/2007 | Tackin et al. | |
| 2007/0091873 | A1 | 4/2007 | LeBlanc et al. | |
| 2007/0110042 | A1 | 5/2007 | Li et al. | |
| 2007/0160154 | A1 | 7/2007 | Sukkar | |

FOREIGN PATENT DOCUMENTS

| | | | |
|---|---|---|---|
| EP | 1 544 848 | A2 | 6/2005 |
| WO | WO 01/02929 | A2 | 1/2001 |
| WO | WO 01/03316 | A1 | 1/2001 |
| WO | WO 01/03317 | A1 | 1/2001 |
| WO | WO 2004/059962 | A1 | 7/2004 |
| WO | WO 2006/104692 | | 10/2006 |

OTHER PUBLICATIONS

Chandran, R., and Marchok, D.J., "Compressed Domain Noise Reduction and Echo Suppression for Network Speech Enhancement," *Proc., 43rd IEEE Midwest Symp. On Circuit and Systems*, pp. 10-13 (2000).

Beaugeant, C., et al., "Gain Loss Control Based on Speech Codec Parameters", *Proc. European Signal Processing Conference*, pp. 409-412 (2004).

Duetsch, N., et al., "Noise Reduction on Speech Codec Parameters", *Proc. International ITG Conference On Source and Channel Coding*, pp. 357-362 (2004).

Sukkar, Rafid, "Coded-Domain Spectrally Matched Noise Injection," Technical Memorandum, Tellabs Operations, Inc., pp. 1-5, Sep. 22, 2006.

Sukkar, R.A., et al., "Dynamic Scaling of Encoded Speech Through the Direct Modification of Coded Parameters," *IEEE*, pp. I-677-I-680 (2006).

Pasanen, Antti, "Coded Domain Level Control for the AMR Speech Codec," *IEEE*, pp. I-685-I-688 (2006).

"Enhanced Variable Rate Codec, Speech Service Option 3 and 68 for Wideband Spread Spectrum Digital Systems," 3rd Generation Partnership Project 2 "3GPP2". Version 1.0, pp. 1-1-10-2, May 2006.

"Enhanced Variable Rate Codec, Speech Service Option 3 for Wideband Spread Spectrum Digital Systems," 3rd Generation Partnership Project 2 "3GPP2". Version 1.0, pp. 1-1-10-3, Apr. 2004.

Breining, et al., "Acoustic Echo Control", *IEEE Signal Processing Magazine*, Jul. 1999, pp. 42-69.

ETSI TS 123 153 V5.12.0 (Sep. 2005), "Universal Mobile Telecommunications System (UMTS)"; Out of band stranscoder control; Stage 2; (Release 5).

ETSI TS 128 062 V5.5.0 (Dec. 2004), "Digital cellular telecommunications system (Phase 2+)"; Universal Mobile Telecommunications System (UMTS); Inband Tandem Free Operation (TFO) of speech codecs; Service description; Stage 3; (Release 5).

* cited by examiner

METHOD AND APPARATUS FOR MODIFYING AN ENCODED SIGNAL FOR VOICE QUALITY ENHANCEMENT

RELATED APPLICATION(S)

This application claims the benefit of U.S. Provisional Application No. 60/665,910 filed Mar. 28, 2005, entitled, "Method and Apparatus for Performing Echo Suppression in a Coded Domain," and U.S. Provisional Application No. 60/665,911 filed Mar. 28, 2005, entitled, "Method and Apparatus for Performing Echo Suppression in a Coded Domain." The entire teachings of these provisional applications are incorporated herein by reference.

BACKGROUND OF THE INVENTION

Speech compression represents a basic operation of many telecommunications networks, including wireless and voice-over-Internet Protocol (VOIP) networks. This compression is typically based on a source model, such as Code Excited Linear Prediction (CELP). Speech is compressed at a transmitter based on the source model and then encoded to minimize valuable channel bandwidth that is required for transmission. In many newer generation networks, such as Third Generation (3G) wireless networks, the speech remains in a Coded Domain (CD) (i.e., compressed) even in a core network and is decompressed and converted back to a Linear Domain (LD) at a receiver. This compressed data transmission through a core network is in contrast with cases where the core network has to decompress the speech in order to perform its switching and transmission. This intermediate decompression introduces speech quality degradation. Therefore, new generation networks try to avoid decompression in the core network if both sides of the call are capable of compressing/decompressing the speech.

In many networks, especially wireless networks, a network operator (i.e., service provider) is motivated to offer a differentiating service that not only attracts customers, but also keeps existing ones. A major differentiating feature is voice quality. So, network operators are motivated to deploy in their network Voice Quality Enhancement (VQE). VQE includes: acoustic echo suppression, noise reduction, adaptive level control, and adaptive gain control.

Echo cancellation, for example, represents an important network VQE function. While wireless networks do not suffer from electronic (or hybrid) echoes, they do suffer from acoustic echoes due to an acoustic coupling between the ear-piece and microphone on an end user terminal. Therefore, acoustic echo suppression is useful in the network.

A second VQE function is a capability within the network to reduce any background noise that can be detected on a call. Network-based noise reduction is a useful and desirable feature for service providers to provide to customers because customers have grown accustomed to background noise reduction service.

A third VQE function is a capability within the network to adjust a level of the speech signal to a predetermined level that the network operator deems to be optimal for its subscribers. Therefore, network-based adaptive level control is a useful and desirable feature.

A fourth VQE function is adaptive gain control, which reduces listening effort on the part of a user and improves intelligibility by adjusting a level of the signal received by the user according to his or her background noise level. If the subscriber background noise is high, adaptive level control tries to increase the gain of the signal that is received by the subscriber.

In the older generation networks, where the core network decompresses a signal into the linear domain followed by conversion into a Pulse Code Modulation (PCM) format, such as A-law or μ-law, in order to perform switching and transmission, network-based VQE has access to the decompressed signals and can readily operate in the linear domain. (Note that A-law and μ-law are also forms of compression (i.e., encoding), but they fall into a category of waveform encoders. Relevant to VQE in a coded domain is source-model encoding, which is a basis of most low bit rate, speech coding.) However, when voice quality enhancement is performed in the network where the signals are compressed, there are basically two choices: a) decompress (i.e., decode) the signal, perform voice quality enhancement in the linear domain, and re-compress (i.e., re-encode) an output of the voice quality enhancement, or b) operate directly on the bit stream representing the compressed signal and modify it directly to effectively perform voice quality enhancement. The advantages of choice (b) over choice (a) are three fold:

First, the signal does not have to go through an intermediate decode/re-encode, which can degrade overall speech quality. Second, since computational resources required for encoding are relatively high, avoiding another encoding step significantly reduces the computational resources needed. Third, since encoding adds significant delays, the overall delay of the system can be minimized by avoiding an additional encoding step.

Performing VQE functions or combinations thereof in the compressed (or coded) domain, however, represents a more challenging task than VQE in the decompressed (or linear) domain.

SUMMARY OF THE INVENTION

A method or corresponding apparatus in an exemplary embodiment of the present invention adaptively controls gain or attenuation of a first encoded signal by first modifying at least one parameter of the first encoded signal, which results in a corresponding at least one modified parameter. The method and corresponding apparatus then replaces the at least one parameter of the first encoded signal with the at least one modified parameter, which results in a second encoded signal. In a decoded state, the second encoded signal approximates a target signal that is a function of two signals, including the first encoded signal (e.g., a near end signal) and a third encoded signal (e.g., a far end signal), in at least partially decoded states.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Coded Domain Voice Quality Enhancement

A method and corresponding apparatus for performing Voice Quality Enhancement (VQE) directly in the coded domain using an exemplary embodiment of the present invention is presented below. As should become clear, no intermediate decoding/re-encoding is performed, thereby avoiding speech degradation due to tandem encodings and also avoiding significant additional delays.

Figure 1:
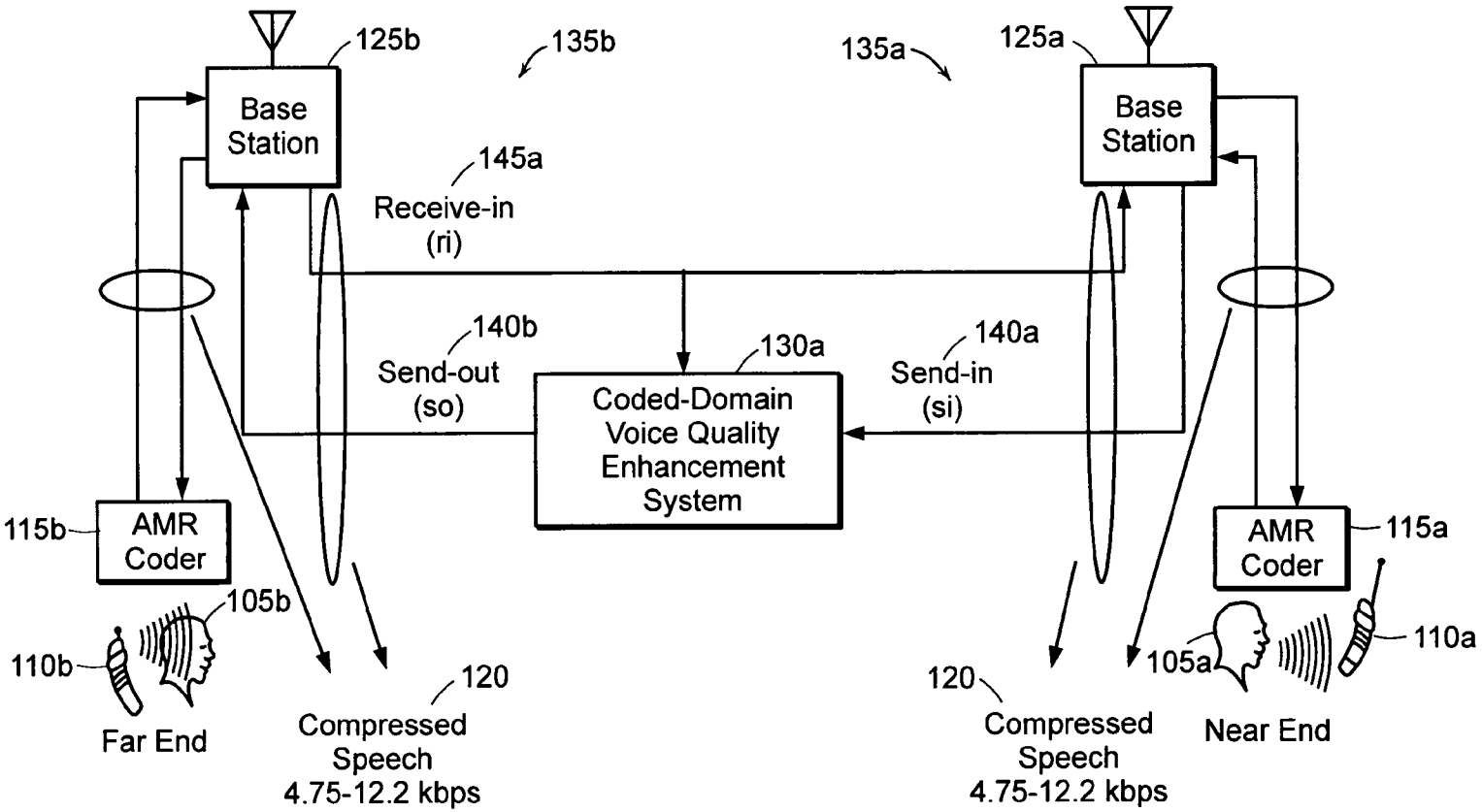
FIG. 1 is a network diagram of a network in which a system performing Coded Domain Voice Quality Enhancement (CD-VQE) using an exemplary embodiment of the present invention is deployed.

FIG. 1 is a block diagram of a network 100 including a Coded Domain VQE (CD-VQE) system 130*a*. For simplicity, the CD-VQE system 130*a* is shown on only one side of a call with an understanding that CD-VQE can be performed on both sides. The one side of the call is referred to herein as the near end 135*a*, and the other side of the call is referred to herein as the far end 135*b*.

In FIG. 1, the CD-VQE system 130*a* is performed on a send-in signal (si) 140*a* generated by a near end user 105*a* using a near end wireless telephone 110*a*. A far end user 105*b* using a far end telephone 110*b* communicates with the near end user 105*a* via the network 100. A near end Adaptive Multi-Rate (AMR) coder 115*a* and a far end AMR coder 115*b* are employed to perform encoding/decoding in the telephones 115*a*, 115*b*. A near end base station 125*a* and a far end base station 125*b* support wireless communications for the telephones 110*a*, 110*b*, including passing through compressed speech 120. Another example includes a network 100 in which the near end wireless telephone 110*a* may also be in communication with a base station 125*a*, which is connected to a media gateway (not shown), which in turn communicates with a conventional wireline telephone or Public Switched Telephone Network (PSTN).

In FIG. 1, a receive-in signal, ri, 145*a*, send-in signal, si, 140*a*, and send-out signal, so, 140*b* are bit streams representing the compressed speech 120. Focus herein is on the CD-VQE system 130*a* operating on the send-in signal, si, 140*a*.

The CD-VQE method and corresponding apparatus disclosed herein is, by way of example, directed to a family of speech coders based on Code Excited Linear Prediction (CELP). According to an exemplary embodiment of the present invention, an Adaptive Multi-Rate (AMR) set of coders is considered an example of CELP coders. However, the method for the CD-VQE disclosed herein is directly applicable to all coders based on CELP. Coders based on CELP can be found in both mobile phones (i.e., wireless phones) as well as wireline phones operating, for example, in a Voice-over-Internet Protocol (VoIP) network. Therefore, the method for CD-VQE disclosed herein is directly applicable to both wireless and wireline communications.

Typically, a CELP-based speech encoder, such as the AMR family of coders, segments a speech signal into frames of 20 msec. in duration. Further segmentation into subframes of 5 msec. may be performed, and then a set of parameters may be computed, quantized, and transmitted to a receiver (i.e., decoder). If m denotes a subframe index, a synthesizer (decoder) transfer function is given by $$D_m(z) = \frac{S(z)}{C_m(z)} = \frac{g_c(m)}{[1 - g_p(m)z^{-T(m)}]\left[1 - \sum_{i=1}^{p} a_i(m)z^{-i}\right]} \quad (1)$$

where S(z) is a z-transform of the decoded speech, and the following parameters are the coded-parameters that are computed, quantized, and sent by the encoder:

$g_c(m)$ is the fixed codebook gain for subframe m, $g_p(m)$ is the adaptive codebook gain for subframe m, T(m) is the pitch value for subframe m, $\{a_i(m)\}$ is the set of P linear predictive coding parameters for subframe m, and $C_m(z)$ is the z-transform of the fixed codebook vector, $c_m(n)$, for subframe m.

Figure 5:
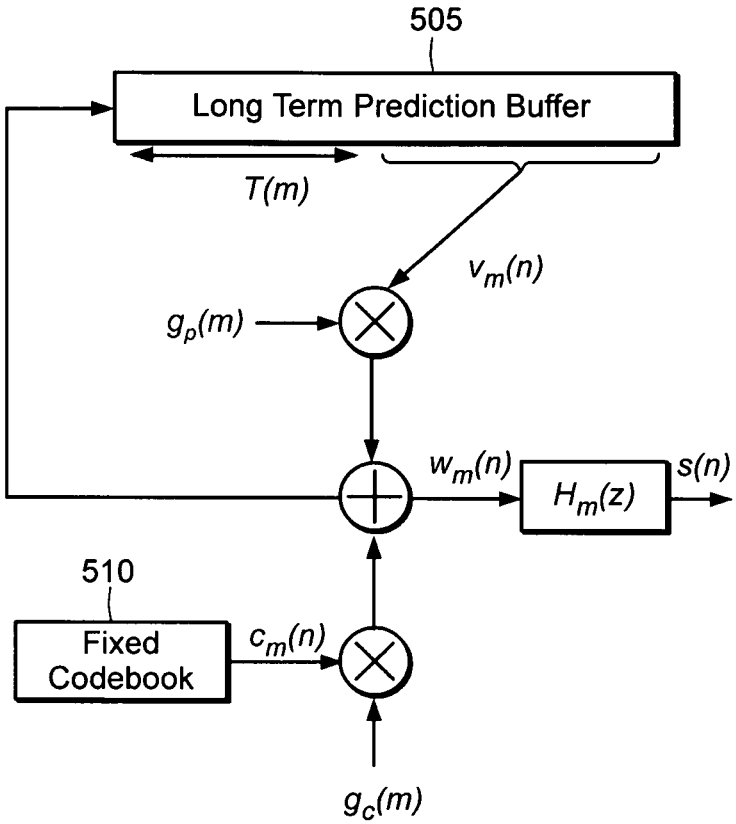
FIG. 5 is a block diagram of a CELP synthesizer used in the coded domain embodiments of FIGS. 1 and 4 and other coded domain embodiments.

FIG. 5 is a block diagram of a synthesizer used to perform the above synthesis. The synthesizer includes a long term prediction buffer 505, used for an adaptive codebook, and a fixed codebook 510, where $v_m(n)$ is the adaptive codebook vector for subframe m, $w_m(n)$ is the Linear Predictive Coding (LPC) excitation signal for subframe m, and $H_m(z)$ is the LPC filter for subframe m, given by $$H_m(z) = \frac{1}{1 - \sum_{i=1}^{p} a_i(m)z^{-i}} \quad (2)$$

Based on the above equation, one can write $$s(n)=w_m(n)*h_m(n) \quad (3)$$

where $h_m(m)$ is the impulse response of the LPC filter, and $$w_m(n)=g_p(m)v_m(n)+g_c(m)c_m(n) \quad (4)$$

Figure 2:
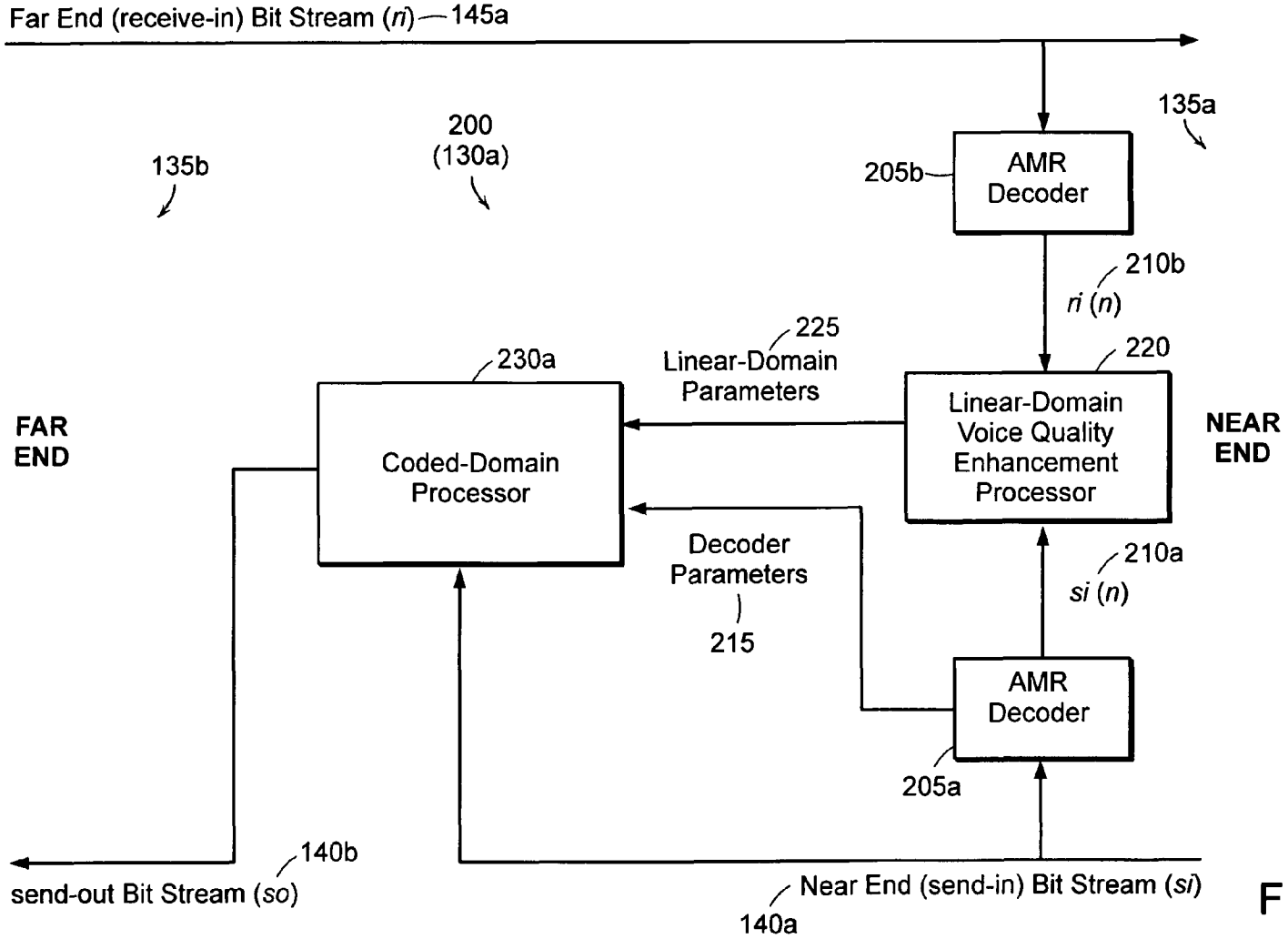
FIG. 2 is a high level view of the CD-VQE system of FIG. 1.

FIG. 2 is a block diagram of an exemplary embodiment of a CD-VQE system 200 that can be used to implement the CD-VQE system 130*a* introduced in FIG. 1. A Coded Domain VQE method and corresponding apparatus are described herein whose performance matches the performance of a corresponding Linear-Domain VQE technique. To accomplish this matching performance, after performing Linear-Domain VQE (LD-VQE), the CD-VQE system 200 extracts relevant information from the LD-VQE. This information is then passed to a Coded Domain VQE.

Specifically, FIG. 2 is a high level block diagram of the approach taken. In this figure, only the near-end side 135*a* of the call is shown, where VQE is performed on the send-in bit stream, si, 140*a*. The send-in and receive-in bit streams 140*a*, 145*a* are decoded by AMR decoders 205*a*, 205*b* (collectively 205) into the linear domain, si(n) and ri(n) signals 210*a*, 210*b*, respectively, and then passed through a linear domain VQE system 220 to enhance the si(n) signal 210*a*. The LD-VQE system 220 can include one or more of the functions listed above (i.e., acoustic echo suppression, noise reduction, adaptive level control, or adaptive gain control). Relevant information is extracted from both the LD-VQE 220 and the AMR decoder 205, and then passed to a coded domain processing unit 230*a*. The coded domain processing unit 230*a* modifies the appropriate parameters in the si bit stream 140*a* to effectively perform VQE.

It should be understood that the AMR decoding 205 can be a partial decoding of the two signals 140*a*, 145*a*. For example, since most LD-VQE systems 220 are typically concerned with determining signal levels or noise levels, a post-filter (not shown) present in the AMR decoders 205 need not be implemented. It should further be understood that, although the si signal 140*a* is decoded into the linear domain, there is no intermediate decoding/re-encoding that can degrade the speech quality. Rather, the decoded signal 210*a* is used to extract relevant information 215, 225 that aids the coded domain processor 230*a* and is not re-encoded after the LD-VQE processor 220.

Figure 3A:
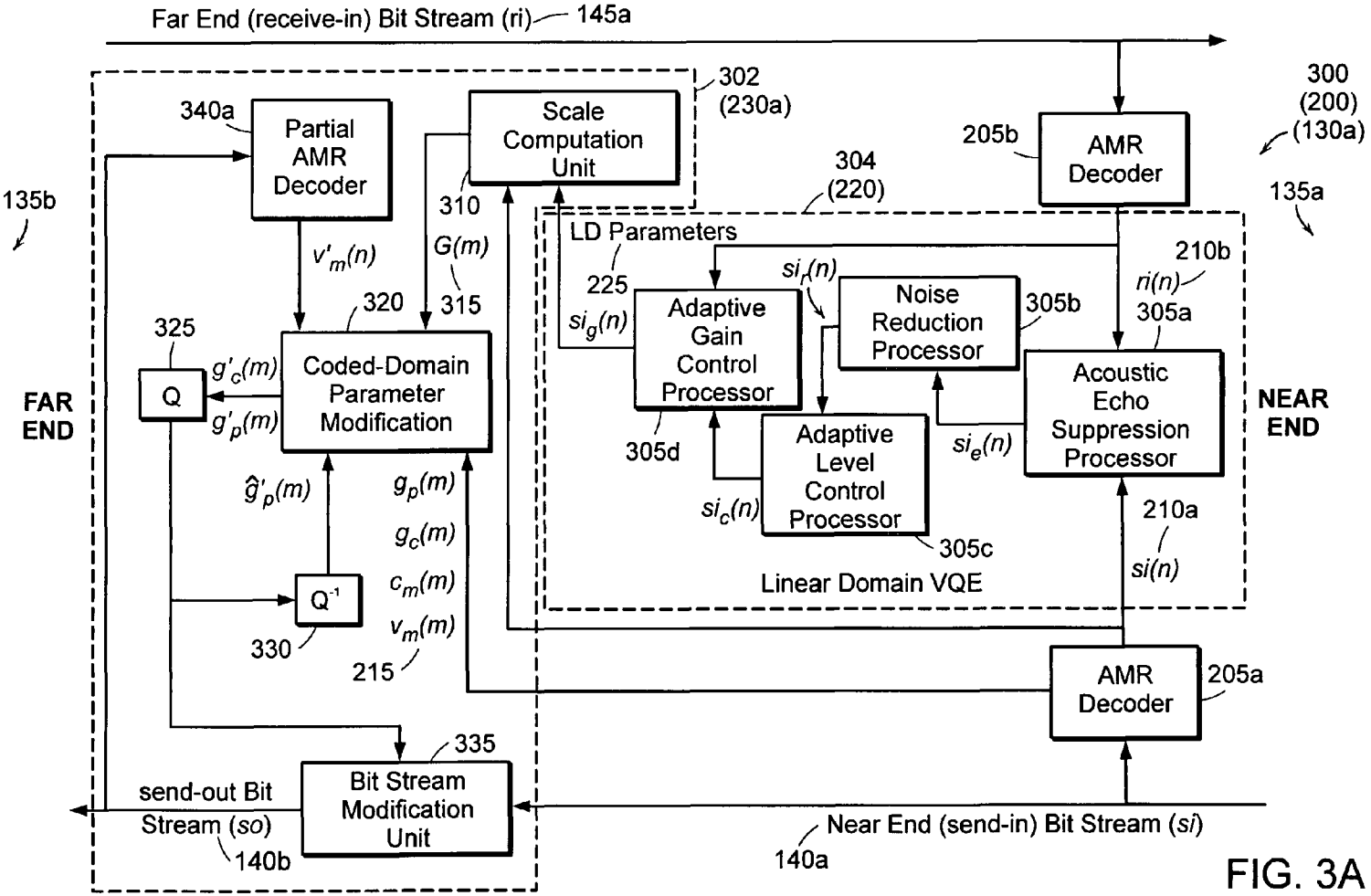
FIG. 3A is a detailed block diagram of the CD-VQE system of FIG. 1.

FIG. 3A is a block diagram of an exemplary embodiment of a CD-VQE system 300 that can be used to implement the CD-VQE systems 130*a*, 200. In this embodiment, an exemplary embodiment of a LD-VQE system 304, used to implement the LD-VQE system 220 of FIG. 2, includes four processors 305*a*, 305*b*, 305*c*, and 305*d* of LD-VQE, But, in general, any number of LD-VQE processors 305*a-d* can be cascaded in exemplary embodiments of the present invention. In exemplary embodiments of the present invention, the problem(s) of VQE in the coded domain are transformed from the processor(s) themselves to one of scaling the signal 140*a* on a segment-by-segment basis.

An exemplary embodiment of a coded domain processor 302 can be used to implement the coded domain processor 230*a* introduced in reference to FIG. 2. In the coded domain processor 302 of FIG. 3, a scaling factor G(m) 315 for a given segment is determined by a scale computation unit 310 that computes power or level ratios between the output signal of the LD-VQE 304 and the linear domain signal si(n) 210*a*. A "Coded Domain Parameter Modification" unit 320 in FIG. 3A employs a Joint Codebook Scaling (JCS) method. In JCS, both a CELP adaptive codebook gain, $g_p(m)$, and a fixed codebook gain, $g_c(m)$, are scaled, and the JCS outputs are the scaled gains, $g'_p(m)$ and $g'_c(m)$. They are then quantized by a quantizer 325 and inserted by a bit stream modification unit 335, also referred to herein as a replacing unit 335, in the send-out bit stream, so, 140*b*, replacing the original gain parameters present in the si bit stream 140*a*. These scaled gain parameters, when used along with the other coder parameters 215 in the AMR decoder 205*a*, produce a signal 140*b* that is an enhanced version of the original signal, si(n), 210*a*.

A dequantizer 330 feeds back dequantized forms of the quantized, adaptive codebook, scaled gain to the Coded Domain Parameter Modification unit 320. Note that decoding the signal ri 145*a* into ri(n) 210*b* is used if one or more of the VQE processors 305*a-d* accesses ri(n) 210*b*. These processors include acoustic echo suppression 305*a* and adaptive gain control 305*d*. If VQE does not require access to ri(n) 210*b*, then decoding of ri 145*a* can be removed from FIGS. 2 and 3A.

Figure 3B:
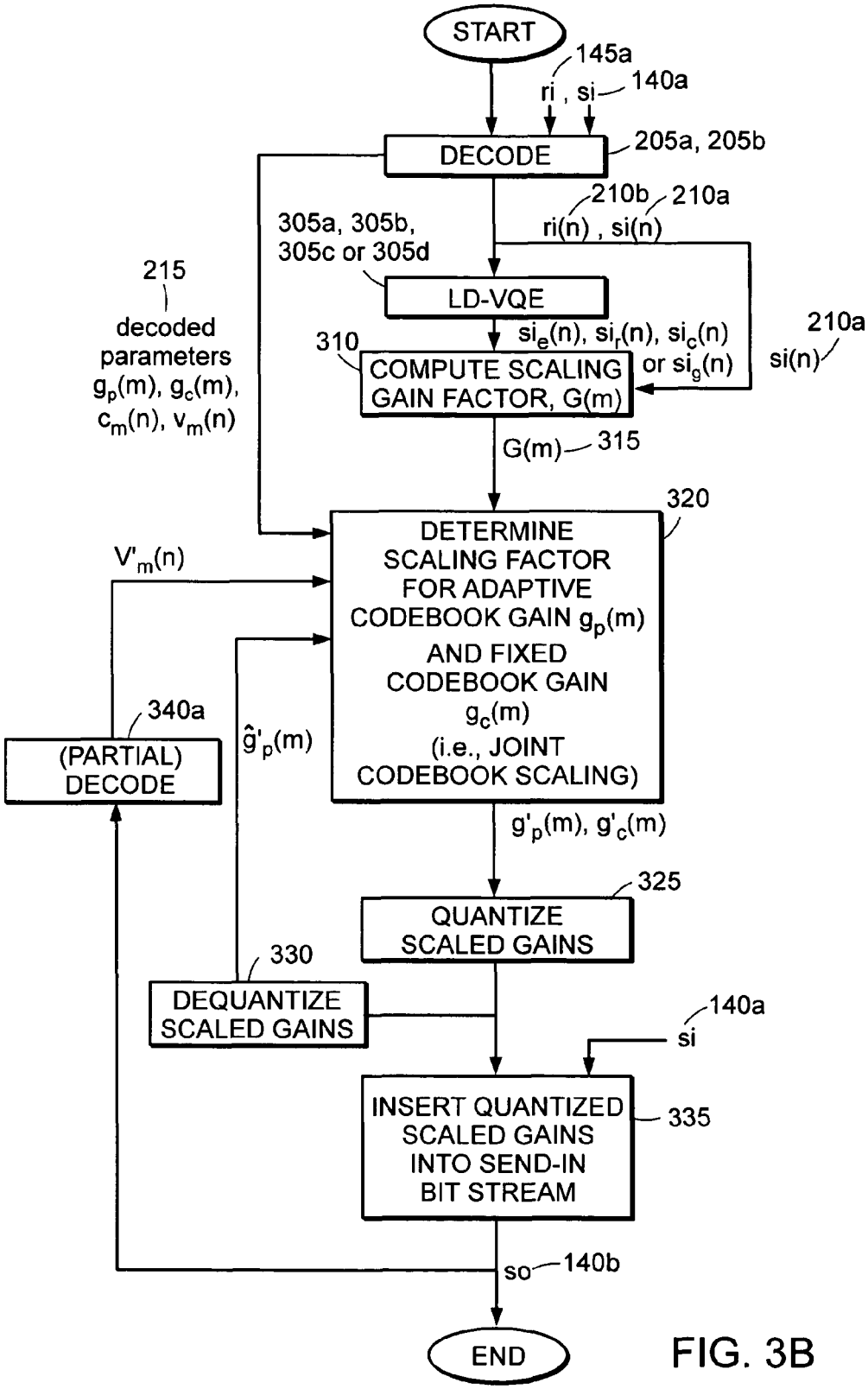
FIG. 3B is a flow diagram corresponding to the CD-VQE system of FIG. 3A.

The operations in the CD-VQE system 300 shown in FIG. 3A are summarized, and presented in the form of a flow diagram in FIG. 3B, immediately below:

(i) The receive input signal bit stream ri 145*a* is decoded into the linear domain signal, ri(n), 210*b* if required by the LD-VQE processors 305*a-d*, specifically acoustic echo suppression 305*a* and adaptive gain control 305*d*.

(ii) The send-in bit stream signal si 140*a* is decoded into the linear domain signal, si(n) 210*a*.

(iii) When more than one of the Linear Domain VQE processors 305*a-d* are used, the Linear-Domain VQE processors 305*a-d* may be interconnected serially, where an input to one processor is the output of the previous processor. The linear domain signal si(n) 210*a* is an input to the first processor (e.g., acoustic echo suppression 305*a*), and the linear domain signal ri(n) 210*b* is a potential input to any of the processors 305*a-d*. The LD-VQE output signal 225 and the linear domain send-in signal si(n) 210*a* are used to compute a scaling factor G(m) 315 on a frame-by-frame basis, where m is the frame index. A frame duration of a scale computation is equal to a subframe duration of the CELP coder. For example, in an AMR 12.2 kbps coder, the subframe duration is 5 msec. The scale computation frame duration is therefore set to 5 msec.

(iv) The scaling factor, G(m), is used to determine a scaling factor for both the adaptive codebook gain $g_p(m)$ and the fixed codebook gain and $g_c(m)$ parameters of the coder. The Coded-Domain Parameter Modification unit 320 employs Joint Codebook Scaling to scale $g_p(m)$ and $g_c(m)$.

(v) The scaled gains $g'_p(m)$ and $g'_c(m)$ are quantized 325 and inserted 335 into the send-out bit stream, so, 140*b* by substituting the original quantized gains in the si bit stream 140*a*.

Coded Domain Echo Suppression

A framework and corresponding method and apparatus for performing acoustic echo suppression directly in the coded domain using an exemplary embodiment of the present invention is now described. As described above in reference to VQE, for acoustic echo suppression performed directly in the coded domain, no intermediate decoding/re-encoding is performed, which avoids speech degradation due to tandem encodings and also avoids significant additional delays.

Figure 4:
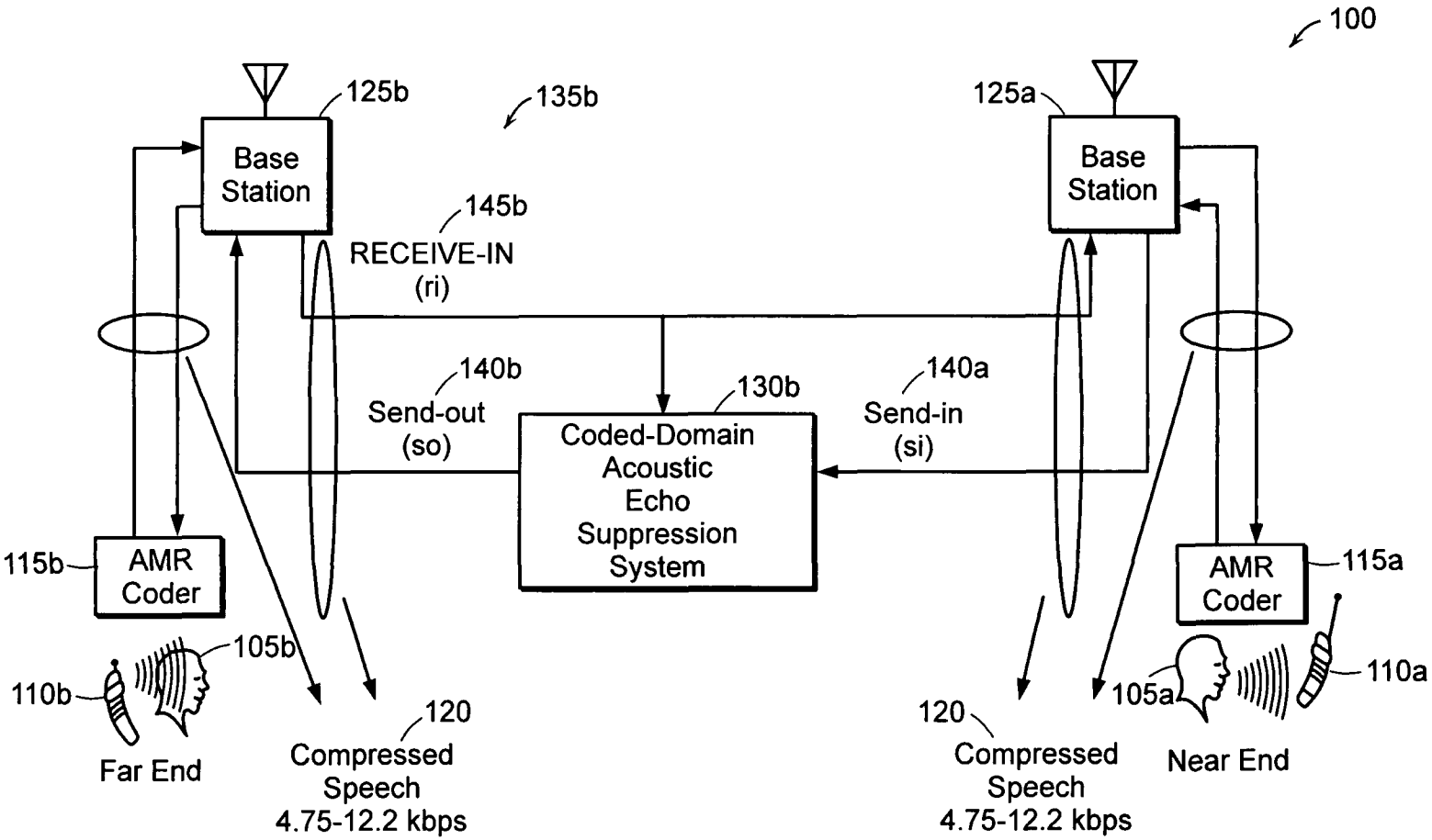
FIG. 4 is a network diagram in which the CD-VQE processor of FIG. 1 is performing Coded Domain Acoustic Echo Suppression (CD-AES)

FIG. 4 is a block diagram of a network 100 using a Coded Domain Acoustic Echo Suppression (CD-AES) system 130*b*. In FIG. 4, the receive-in signal, ri, 145*a*, the send-in signal, si, 140*a*, and the send-out signal, so, 140*b* are bit streams representing compressed speech 120.

The CD-AES method and corresponding apparatus 130*b* is applicable to a family of speech coders based on Code Excited Linear Prediction (CELP). According to an exemplary embodiment of the present invention, the AMR set of coders 115 are considered an example of CELP coders. However, the method for CD-AES presented herein is directly applicable to all coders based on CELP The Coded Domain Echo suppression method and corresponding apparatus 130*b* meets or exceeds the performance of a corresponding Linear Domain-Echo Suppression technique. To accomplish such performance, a Linear-Domain Echo Acoustic Suppression (LD-AES) unit 305*a* is used to provide relevant information, such as decoder parameters 215 and linear-domain parameters 225. This information 215, 225 is then passed to a coded domain processing unit 230*b*.

Figure 6:
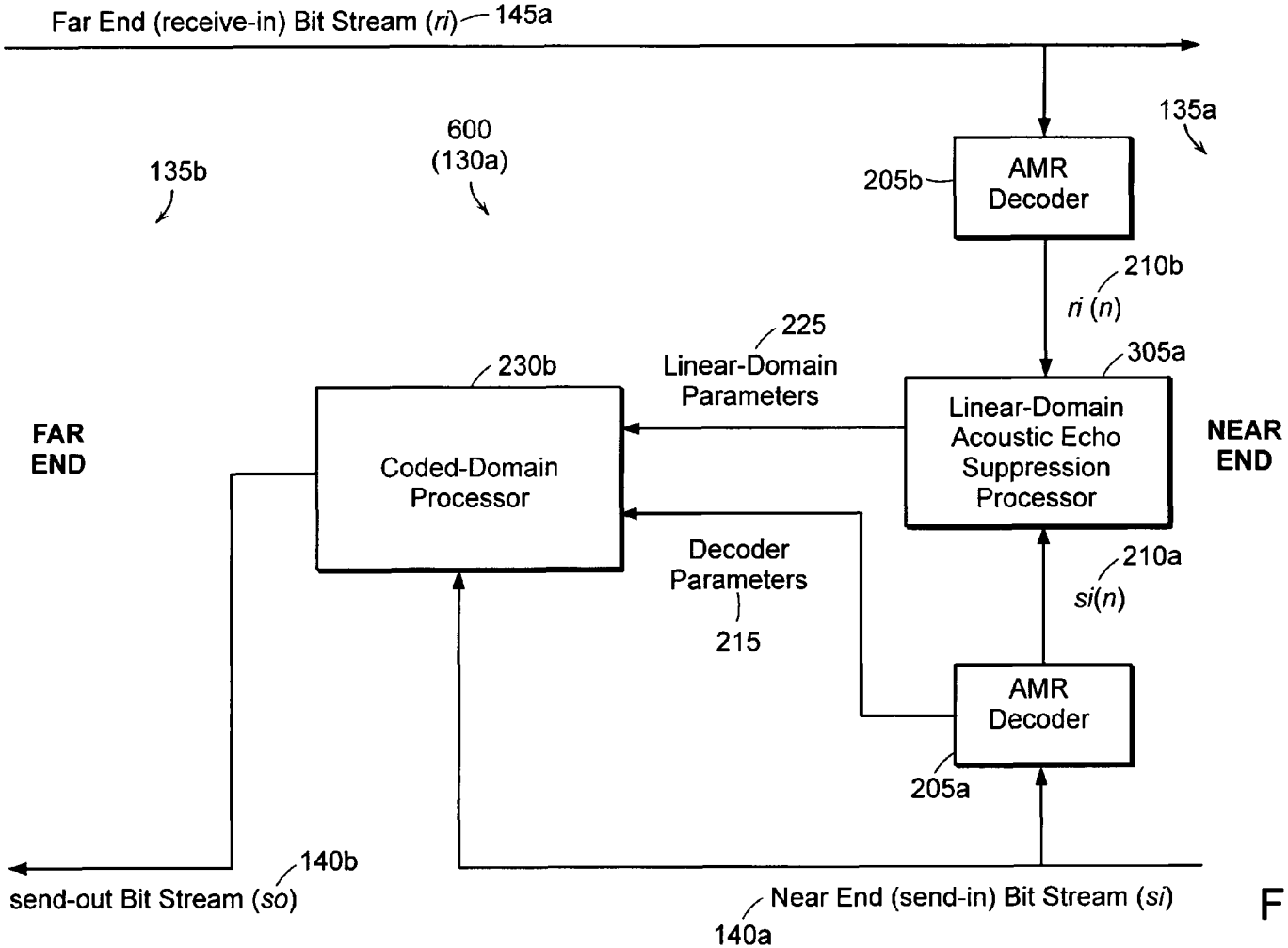
FIG. 6 is a high level block diagram of the CD-AES system of FIG. 4.

FIG. 6 is a high level block diagram of an approach used for performing Coded Domain Acoustic Echo Suppression (CD-AES), or Coded Domain Echo Suppression (CD-ES) when the source of the echo is other than acoustic. An exemplary CD-AES system 600 can be used to implement the CD-AES system 130*b* of FIG. 4. In FIG. 6, both the ri and si bit streams 145*a*, 140*a* are decoded into the linear domain signals, ri(n) 210*b* and si(n) 210*a*, respectively. They are then passed through a conventional LD-AES processor 305*a* to suppress possible echoes in the si(n) signal 210*a*. Relevant information is extracted from both LD-AES and the AMR decoding processes 305*a* and 205*a*, respectively, and then passed to the coded domain processor 230*b*. The coded domain processor 230*b* modifies appropriate parameters in the si bit stream 140*a* to effectively suppress possible echoes in the signal 140*a*.

It should be understood that the AMR decoding 205 can be a partial decoding of the two signals 140*a*, 145*a*. For example, since the LD-AES processor 305*a* is typically based on signal levels, the post-filter present in the AMR decoders 205 need not be implemented since it does not affect the overall level of the decoded signal. It should further be understood that, although the si signal 140*a* is decoded into the linear domain, there is no intermediate decoding/re-encoding that can degrade the speech quality. Rather, the decoded signal 210*a* is used to extract relevant information that aids the coded domain processor 230*b* and is not re-encoded after the LD-AES processor 305*a*.

Figure 7A:
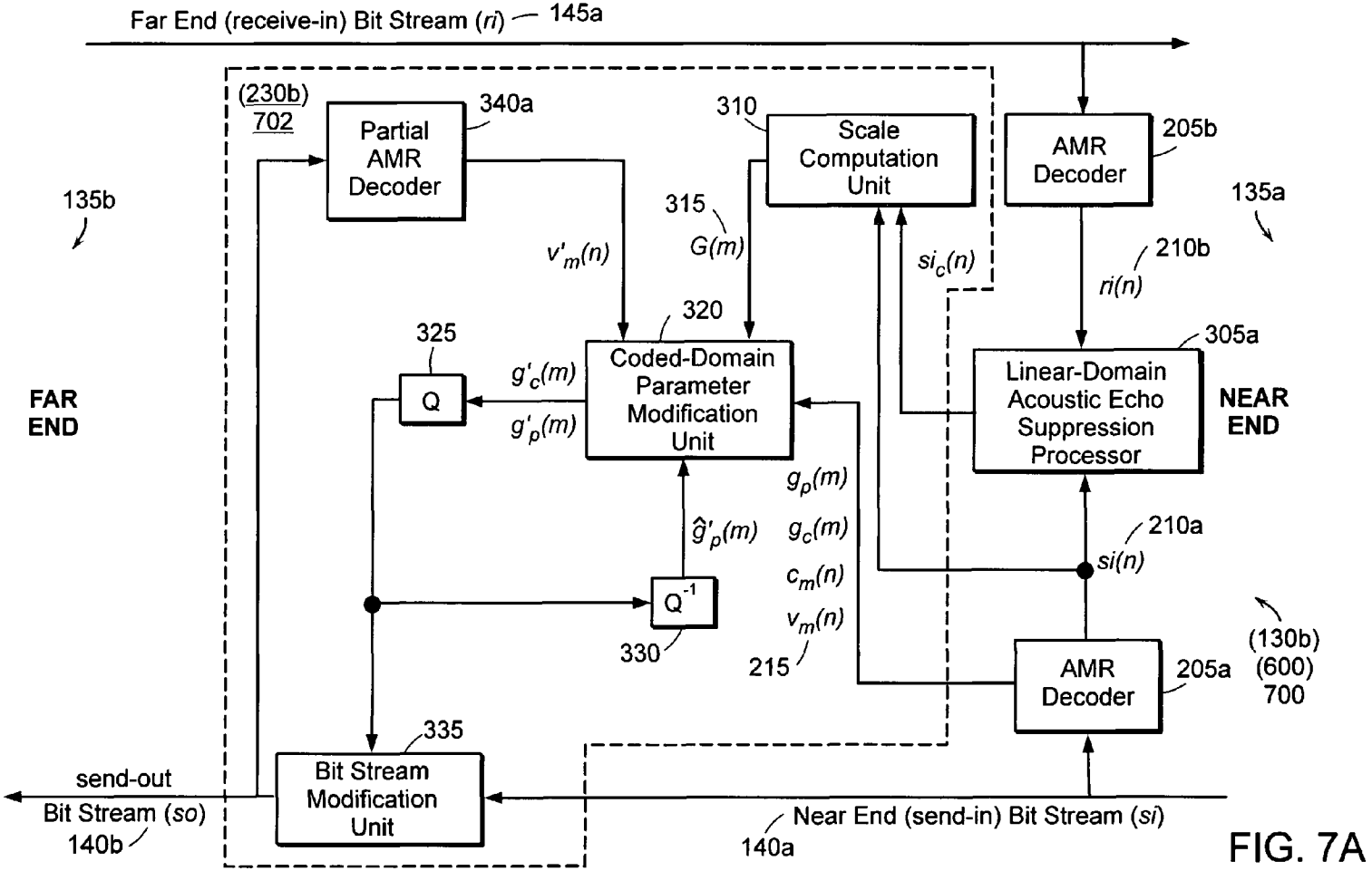
FIG. 7A is a detailed block diagram of the CD-AES system of FIG. 4.

FIG. 7A is a detailed block diagram of an exemplary embodiment of a CD-AES system 700 that can be used to implement the CD-AES systems 130*b*, 600 of FIGS. 4 and 6. Given the fact that the outcome of a conventional LD-AES system 305*a* is to adaptively scale the linear domain signal si(n) 210*a* so as to suppress any possible echoes and pass through any near end speech, the coded domain echo suppression unit 700 operates as follows: it modifies the bit stream, si, 140*a* so that the resulting bit stream, so, 140*b* when decoded, results in a signal, so(n), 210*a* that is as close as possible to the linear domain echo-suppressed signal, $si_e(n)$, also referenced to herein as a target signal. Therefore, since $Si_e(n)$ is typically a scaled version of si(n) 210*a*, the problem of the coded domain echo suppression is transformed to a problem of how properly to modify a given encoded signal bit stream to result, when decoded, in an adaptively scaled version of the signal corresponding to the original bit stream. The scaling factor G(m) 315 is determined by the scale computation unit 310 by comparing the energy of the signal si(n) 210*a* to the energy of the echo suppressed signal $si_e(n)$.

Figure 7B:
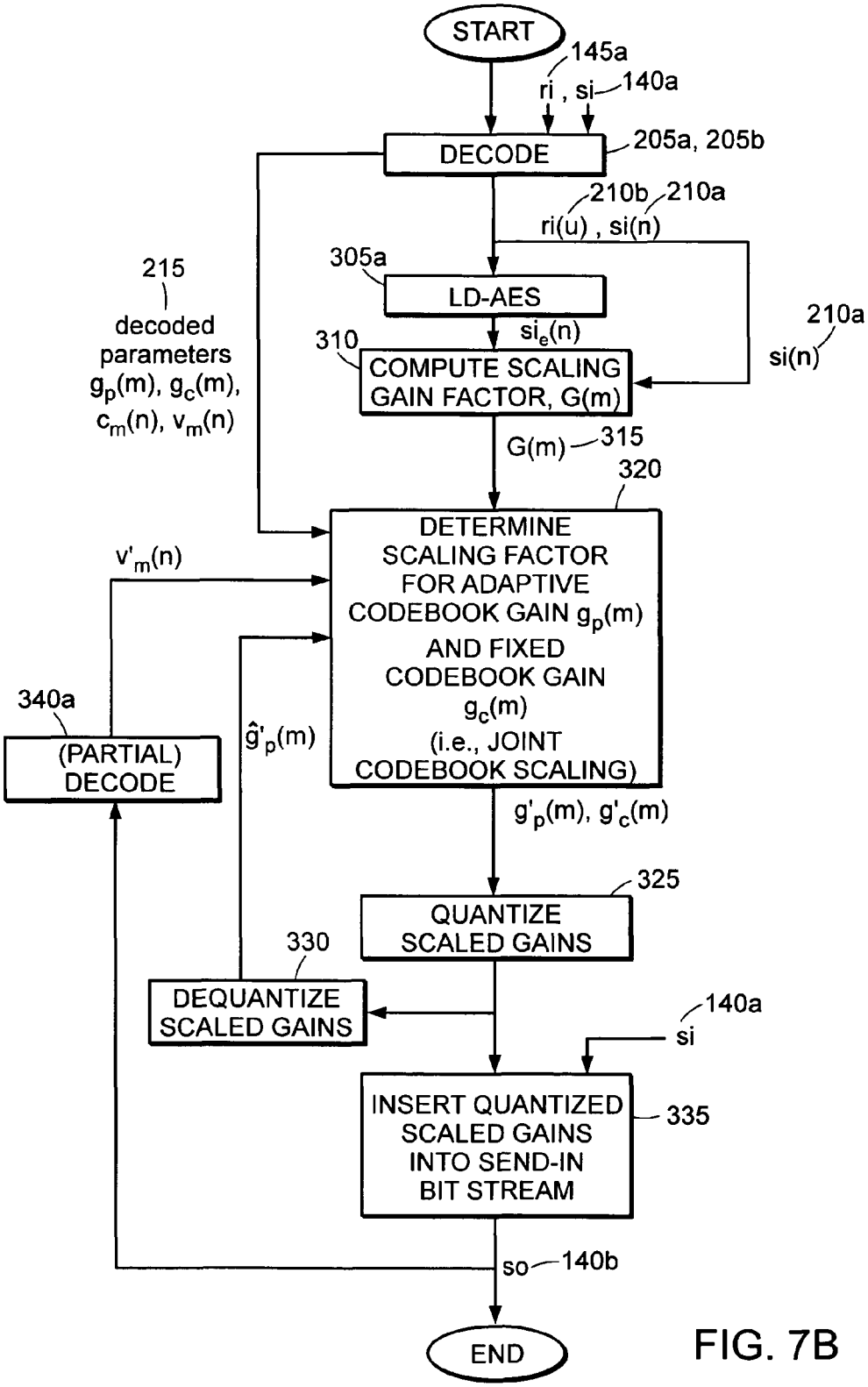
FIG. 7B is a flow diagram corresponding to the CD-AES system of FIG. 7A.

Before addressing the coded domain scaling problem, a summary of the operations in the CD-AES system 700 shown in FIG. 7A is presented in the form of a flow diagram in FIG. 7B:

(i) The bit streams ri 145*a* and si 140*a* are decoded 205*a*, 205*b* into linear signals, ri(n) 210*b* and si(n) 210*a*.

(ii) A Linear-Domain Acoustic Echo Suppression processor 305*a* that operates on ri(n) 210*b* and si(n) 210*a* is performed. The LD-AES processor 305*a* output is the signal $si_e(n)$, which represents the linear domain send-in signal, si(n), 210*a* after echoes have been suppressed.

(iii) A scale computation unit 310 determines the scaling factor G(m) 315 between si(n) 210*a* and $si_e(n)$. A single scaling factor, G(m), 315 is computed for every frame (or subframe) by buffering a frame worth of samples of si(n) 210*a* and $si_e(n)$ and determining a ratio between them. One possible method for computing G(m) 315 is a simple power ratio between the two signals in a given frame. Other methods include computing a ratio of the absolute value of every sample of the two signals in a frame, and then taking a median, or average of the sample ratio for the frame, and assigning the result to G(m) 315. The scaling factor 315 can be viewed as the factor by which a given frame of si(n) 210*a* has to be scaled by to suppress possible echoes in the coded domain signal 140*a*. The frame duration of the scale computation is equal to the subframe duration of the CELP coder. For example, in the AMR 12.2 bps coder, the subframe duration is 5 msec. The scale computation frame duration is therefore set to 5 msec. also.

(iv) The scaling factor, G(m), 315 is used to determine 320 a scaling factor for both the adaptive codebook gain $g_p(m)$ and the fixed codebook gain parameters $g_c(m)$ of the coder. The Coded-Domain Parameter Modification unit 320 employs the Joint Codebook Scaling method to scale $g_p(m)$ and $g_c(m)$.

(v) The scaled gains $g_p(m)$ and $g_c(m)$ are quantized 325 and inserted 335 into the send-out bit stream, so, 140*b* by substituting the original quantized gains in the si bit stream 140*a*.

Signal Scaling in the Coded Domain

The problem of scaling the speech signal 140*a* by modifying its coded parameters directly has applications not only in Acoustic Echo Suppression, as described immediately above, but also in applications such as Noise Reduction, Adaptive Level Control, and Adaptive Gain Control, as are described below. Equation (1) above suggests that, by scaling the fixed codebook gain, $g_c(m)$, by a given factor, G, a corresponding speech signal, which is also scaled by G, can be determined directly. However, this is true if the synthesis transfer function, $D_m(z)$, is time-invariant. But, it is clear that $D_m(z)$ is a function of the subframe index, m, and, therefore, is not time-invariant.

Previous coded domain scaling methods that have been proposed modify the fixed codebook gain, $g_c(m)$. See C. Beaugeant, N. Duetsch, and H. Taddei, "Gain Loss Control Based on Speech Codec Parameters," in *Proc. European Signal Processing Conference*, pp. 409-412, September 2004. Other methods, such as proposed by R. Chandran and D. J. Marchok, "Compressed Domain Noise Reduction and Echo Suppression for Network Speech Enhancement," in *Proc. 43rd IEEE Midwest Symp. on Circuits and Systems*, pp. 10-13, August 2000, try to adjust both gains based on some knowledge of the nature of the given speech segment or subframe (e.g., voiced vs. unvoiced).

In contrast, exemplary embodiments of the present invention do not require knowledge of the nature of the speech subframe. It is assumed that the scaling factor, G(m), 315 is calculated and used to scale the linear domain speech subframe. This scaling factor 315 can come from, for example, a linear-domain processor, such as acoustic echo suppression processor, as discussed above. Therefore, given G(m) 315, an analytical solution jointly scales both the adaptive codebook gain, $g_p(m)$, and the fixed codebook gain, $g_c(m)$, such that the resulting coded parameters, when decoded, result in a properly scaled linear domain signal. This joint scaling, described in detail below, is based on preserving a scaled energy of an adaptive portion of the excitation signal, as well as a scaled energy of the speech signal. This method is referred to herein as Joint Codebook Scaling (JCS).

The Coded Domain Parameter Modification unit 320 in FIG. 7A executes JCS. It has the inputs listed below. For simplicity and without loss of generality, the subframe index, m, is dropped with the understanding that the processing units can operate on a subframe-by-subframe basis.

(i) The gain, G, is to be applied for a given subframe as determined by the scale computation unit 310 following the LD-AES processor 305*a*.

(ii) The adaptive and fixed codebook vectors, v(n) and c(n), respectively, correspond to the original unmodified bit stream, si, 140*a*. These vectors are already determined in the decoder 205*a* that produces si(n), 210*a*, as FIG. 7A shows. Therefore, they are readily available to the JCS processor 320.

(iii) The adaptive and fixed codebook gains, $g_p$ and $g_c$, respectively, correspond to the original unmodified bit stream, si, 140*a*. These gain parameters are already determined in the decoder 205*a* that produces si(n) 210*a*. Therefore, they are readily available to the scaling processor 310.

(iv) The adaptive codebook vector, v'(n), of the subframe excitation signal corresponding to the modified (scaled) bit stream, so, 140*b* is provided by the partial AMR decoder 340*a*.

(v) The scaled version of the adaptive codebook gain, $\hat{g}'_p$, after going through quantization/de-quantization processors 325, 330, is fed back to the JCS processor 320.

Note that the decoder 340*a* operating on the send-out modified bit stream, so, 140*b* need not be a full decoder. Since its output is the adaptive codebook vector, the LPC synthesis operation ($H_m(z)$ in FIG. 5) need not be performed in this decoder 340*a*.

Let x(n) be the near-end signal before it is encoded and transmitted as the si bit stream 140*a* in FIG. 7A. Let $g_p$ be the adaptive codebook gain for a given subframe corresponding to x(n). According to the encoding, $g_p$ is computed as described by Adaptive Multi-Rate (AMR): Adaptive Multi-Rate (AMR) Speech Codec Transcoding Functions, 3rd Generation Partnership Project Document number 3GPP TS 26.090, according to the following equation:

$$g_p = \frac{\sum_{n=0}^{N-1} x(n)y(n)}{\sum_{n=0}^{N-1} y^2(n)} \tag{5}$$

where N is the number of samples in the subframe, and y(n) is the filtered adaptive codebook vector given by:

$$y(n)=v(n)*h(n) \tag{6}$$

Here, v(n) is the adaptive codebook vector, and h(n) is the impulse response of the LPC synthesis filter.

If the near end speech input were scaled by G at any given subframe, then the adaptive codebook gain is determined according to $$g_p^{(s)} = \frac{G\sum_{n=0}^{N-1} x(n)y(n)}{\sum_{n=0}^{N-1} y^2(n)} = Gg_p \tag{7}$$

The resulting energy in the adaptive portion of the excitation signal is therefore given by $$[g_p^{(s)}]^2 \sum_{n=0}^{N-1} v^2(n) = G^2 g_p^2 \sum_{n=0}^{N-1} v^2(n) \tag{8}$$

The criterion used in scaling the adaptive codebook gain, $g_p$, is that the energy of the adaptive portion of the excitation is preserved. That is, $$(g'_p)^2 \sum_{n=0}^{N-1} (v'(n))^2 = G^2 g_p^2 \sum_{n=0}^{N-1} v^2(n) \tag{9}$$

where v'(n) is the adaptive codebook vector of the (partial) decoder 340*a* operating on the scaled bit stream (i.e., the send-out bit stream, so), and $g'_p$ is the scaled adaptive codebook gain that is quantized 325 and inserted 335 into the bit stream 140*a* to produce the send-out bit stream, so, 140*b*. Since the pitch lag is preserved and not modified as part of the scaling, v'(n) is based on the same pitch lag as v(n). However, since the scaled decoder has a scaled version of the excitation history, v'(n) is different from v(n).

The scaled adaptive codebook gain can be written as $$g'_p = K_p g_p \tag{10}$$

where $K_p$ is the scaling factor for the adaptive codebook gain. According to Equation (9), $K_p$ is given by:

$$K_p = G\left[\frac{\sum_{n=0}^{N-1} v^2(n)}{\sum_{n=0}^{N-1} (v'(n))}\right]^{1/2} \tag{11}$$

Turning now to the fixed codebook gain, the criterion used in scaling $g_c$ is to preserve the speech signal energy. The total subframe excitation at the decoder that operates on the original bit stream, si, 140*a* is given by:

$$w(n)=g_p v(n)+g_c c(n) \tag{12}$$

The energy of the resulting decoded speech signal in a given subframe is $$E_x = \sum_{n=0}^{N-1} (w(n) * h(n))^2 \tag{13}$$

where the initial conditions of the LPC filter, h(n), are preserved from the previous subframe synthesis. If the speech is scaled at any given subframe by G, then the speech energy becomes:

$$E_x^{(s)} = G^2 \sum_{n=0}^{N-1} (w(n) * h(n))^2 = \sum_{n=0}^{N-1} (Gw(n) * h(n))^2 \tag{14}$$

Therefore, scaling the speech is equivalent to scaling the total excitation by G. This is generally true if the initial conditions of h(n) are zero. However, an approximation is made that this relationship still holds even when the initial conditions are the true initial conditions of h(n). This approximation has an effect that the scaling of the decoded speech does not happen instantly. However, this scaling delay is relatively short for the acoustic echo suppression application.

Given equation (14) and the scaled adaptive gain of equation (10), the goal then becomes to determine the scaled fixed codebook gain, such that $$E_x^{(s)} = G^2 \sum_{n=0}^{N-1} w^2(n) = \sum_{n=0}^{N-1} (w'(n))^2 \tag{15}$$

where w'(n) is the total excitation corresponding to the scaled bit stream, so, 140*b* and is given by $$w'(n)=g'_p v'(n)+g'_c c(n) \tag{16}$$

Note that the fixed codebook vector, c(n), is the same as the fixed codebook vector in equation (12) for w(n) since the scaling does not modify the fixed codebook vector. The goal then becomes:

$$G^2 \sum_{n=0}^{N-1} w^2(n) = \sum_{n=0}^{N-1} (g'_p v'(n) + g'_c c(n))^2 \tag{17}$$

The adaptive codebook gain, $g'_p$, is determined by equations (10) and (11). However, to preserve the speech energy at the decoder, the quantized version of the gain, $\hat{g}'_p$, is used in Equation (17), resulting in $$G^2 \sum_{n=0}^{N-1} w^2(n) = \sum_{n=0}^{N-1} (g'_p v'(n) + g'_c c(n))^2 \tag{18}$$

Equation (18) can be rewritten as a quadratic equation in $g'_c$ as:

$$\left(\sum_{n=0}^{N-1} c^2(n)\right)(g'_c)^2 + \left(2\sum_{n=0}^{N-1} \hat{g}'_p v'(n)c(n)\right)g'_c + \left(\sum_{n=0}^{N-1} (\hat{g}'_p v'(n))^2 - G^2 \sum_{n=0}^{N-1} w^2(n)\right) = 0 \tag{19}$$

Solving for the roots of the quadratic equation (19), the scaled fixed codebook gain, $g'_c$, is set to the positive real-valued root. In the event that both roots are real and positive, either root can be chosen. One strategy that may be used is to set $g'_c$ to the root with the larger value. Another strategy is to set $g'_c$ to the root that gives the closer value to $Gg_c$. The scale factor for the fixed codebook gain is then given by, $$K_c = \frac{g'_c}{g_c} \tag{20}$$

where $g'_c$ is a positive real-valued root of equation (19).

In some rare cases, no positive real-valued root exists for equation (19). The roots are either negative real-valued or complex, implying no valid answer exists for $g'_c$. This can be due to the effects of quantization. In these cases, a back-off scaling procedure may be performed, where $K_c$ is set to zero, and the scaled adaptive codebook gain is determined by preserving the energy of the total excitation. That is, $$K_p = G\left[\frac{\sum_{n=0}^{N-1} w^2(n)}{\sum_{n=0}^{N-1} (v'(n))^2}\right]^{1/2} \tag{21}$$

Experimental Results

To examine the performance of the JCS method, it may be compared it to the method where $g_c$ is scaled by the desired scaling factor, G, similar to what is proposed in Beaugeant et al., supra. For reference, this method is referred to herein as the "Fixed Codebook Scaling" method.

Figure 8:
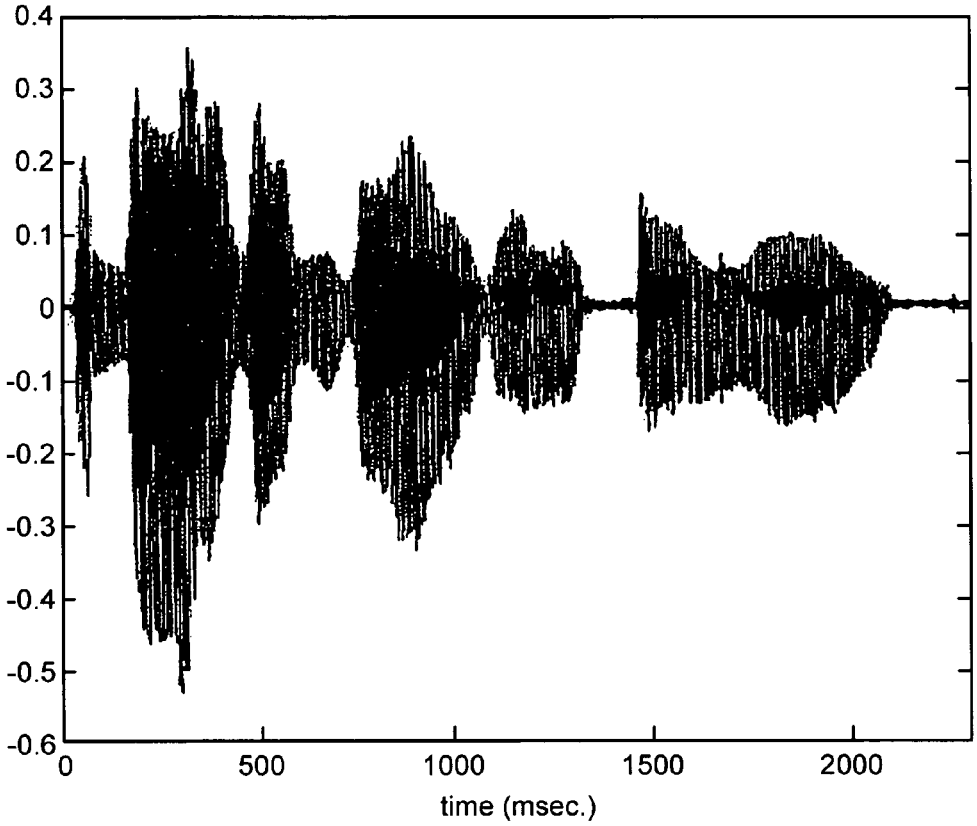
FIG. 8 is a plot of a decoded speech signal processed by the CD-AES system of FIG. 4.
Figure 9:
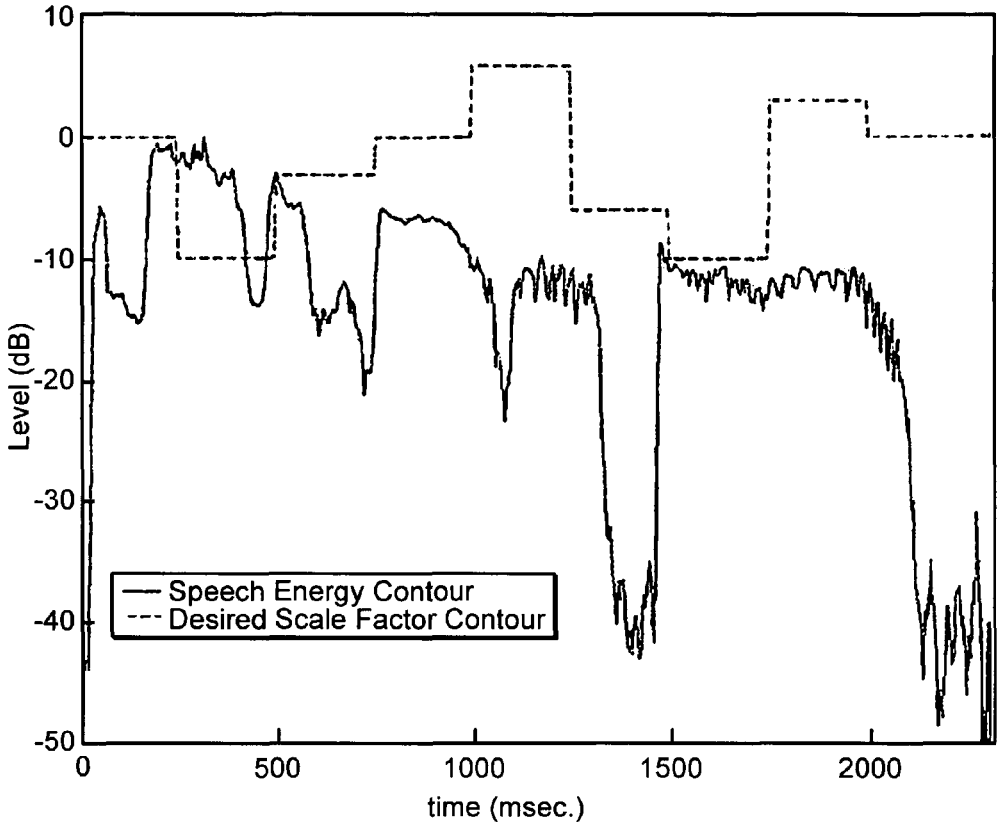
FIG. 9 is a plot of an energy contour of the speech signal of FIG. 8.

FIG. 8 shows a 12.2 kbps AMR decoded speech signal representing a sentence spoken by a female speaker. FIG. 9 shows the energy contour of this signal, where the energy is computed on 5 msec. segments. Superimposed on the energy contour in FIG. 9 is an example of a desired scale factor contour by which it is preferable to scale the signal in its coded domain, for reasons described above. This scale factor contour is manually constructed so as to have varying scaling conditions and scaling transitions.

The JCS method described above was applied to in this example. After performing the parameter scaling, the resulting bit stream was decoded into a linear domain signal. As the decoding operation was performed, the synthesized LPC excitation signal was also saved. The ratio of the energy of the LPC excitation signal corresponding to the scaled parameter bit stream to the energy of the LPC excitation corresponding to the original non-scaled parameter bit stream was then computed. Specifically, the following equation was computed $$R_e = \frac{\sum_{n=0}^{N-1} (w'(n))^2}{\sum_{n=0}^{N-1} w^2(n)} \tag{22}$$

The excitation signal w'(n) in Equation (22) is the actual excitation signal seen at the decoder (i.e., after re-quantization of the scaled gain parameters). Ideally, $R_e$ should track as much as possible the scale factor contour given in FIG. 9.

Figure 10:
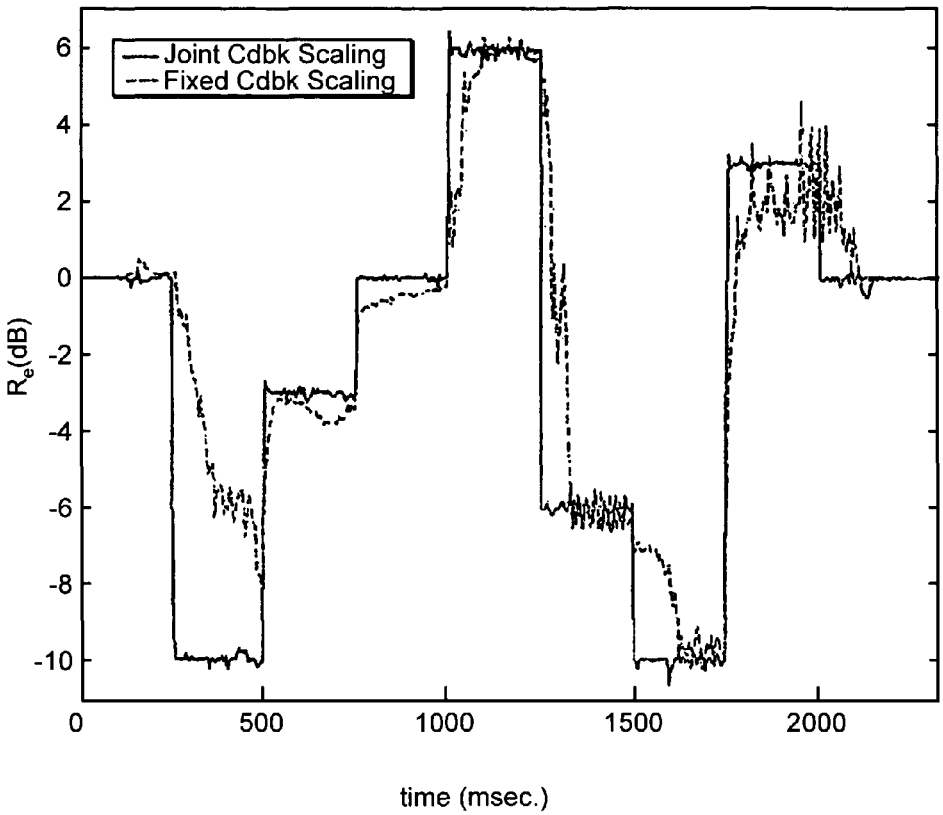
FIG. 10 is a plot of a synthesis LPC excitation energy scale ratio corresponding to the energy contour of FIG. 9.

FIG. 10 shows a comparison of the ratio, $R_e$, between the JCS method and the Fixed Codebook Scaling method. It is clear from this figure, the JCS method tracks more closely the desired scaling factor contour. The ultimate goal, however, is to scale the resulting decoded speech signal.

Figure 11:
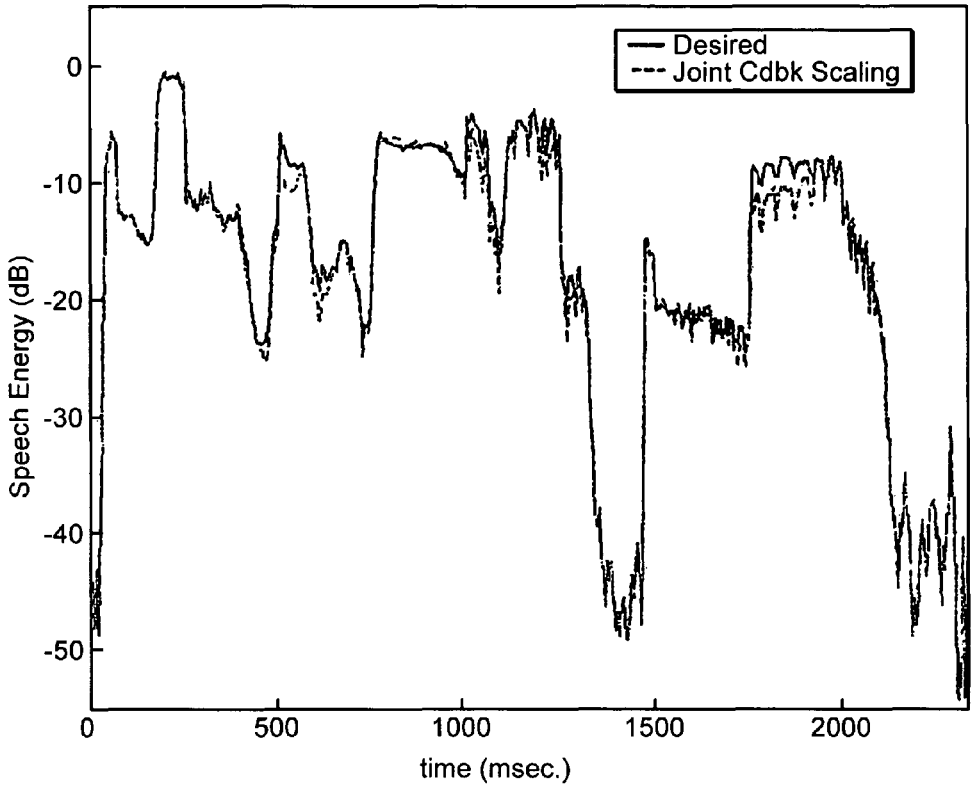
FIG. 11 is a plot of a decoded speech energy contour resulting from Joint Codebook Scaling (JCS) used in the CD-AES system of FIG. 7A.

FIG. 11 shows the energy contour of the decoded speech signal using the JCS method superimposed on the desired energy contour of the decoded speech signal. This desired contour is obtained by multiplying (or adding in the log scale) the energy contour in FIG. 9 by the desired scaling factor that is superimposed on FIG. 9.

Figure 12:
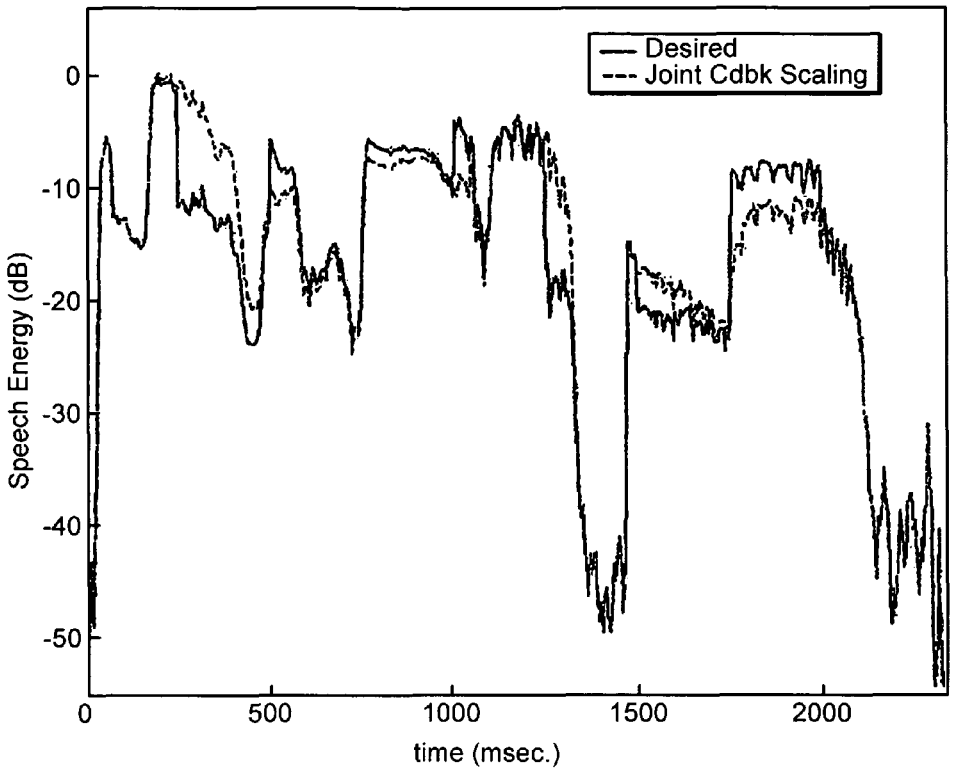
FIG. 12 is a plot of a decoded speech energy contour for fixed codebook scaling shown for comparison purposes to FIG. 11.

FIG. 12 is a similar plot for the Fixed Codebook Scaling. It can also be seen here that the JCS results in a better tracking of the desired speech energy contour.

CD-AES with Spectrally Matched Noise Injection (SMNI)

Typically in echo suppression, it is desirable to heavily suppress the signal when it is detected that there is only far end speech with no near end speech and that an echo is present in the send-in signal. This heavy suppression significantly reduces the echo, but it also introduces discontinuity in the signal, which can be discomforting or annoying to the far end listener. To remedy this, comfort noise is typically injected to replace the suppressed signal. The comfort noise level is computed based on the signal power of the background noise at the near end, which is determined during periods when neither the far end user nor the near end user is talking. Ideally, to make the signal even more natural sounding, the spectral characteristics of the comfort noise needs to match closely a background noise of the near end. When echo suppression is performed in the linear domain, Spectrally Matched Noise Injection (SMNI) is typically done by averaging a power spectrum during segments of no speech activity at both ends and then injecting this average power spectrum when the signal is to be suppressed. However, this procedure is not directly applicable to the coded domain. Here, a method and corresponding apparatus for SMNI is provided in the coded domain.

Figure 13A:
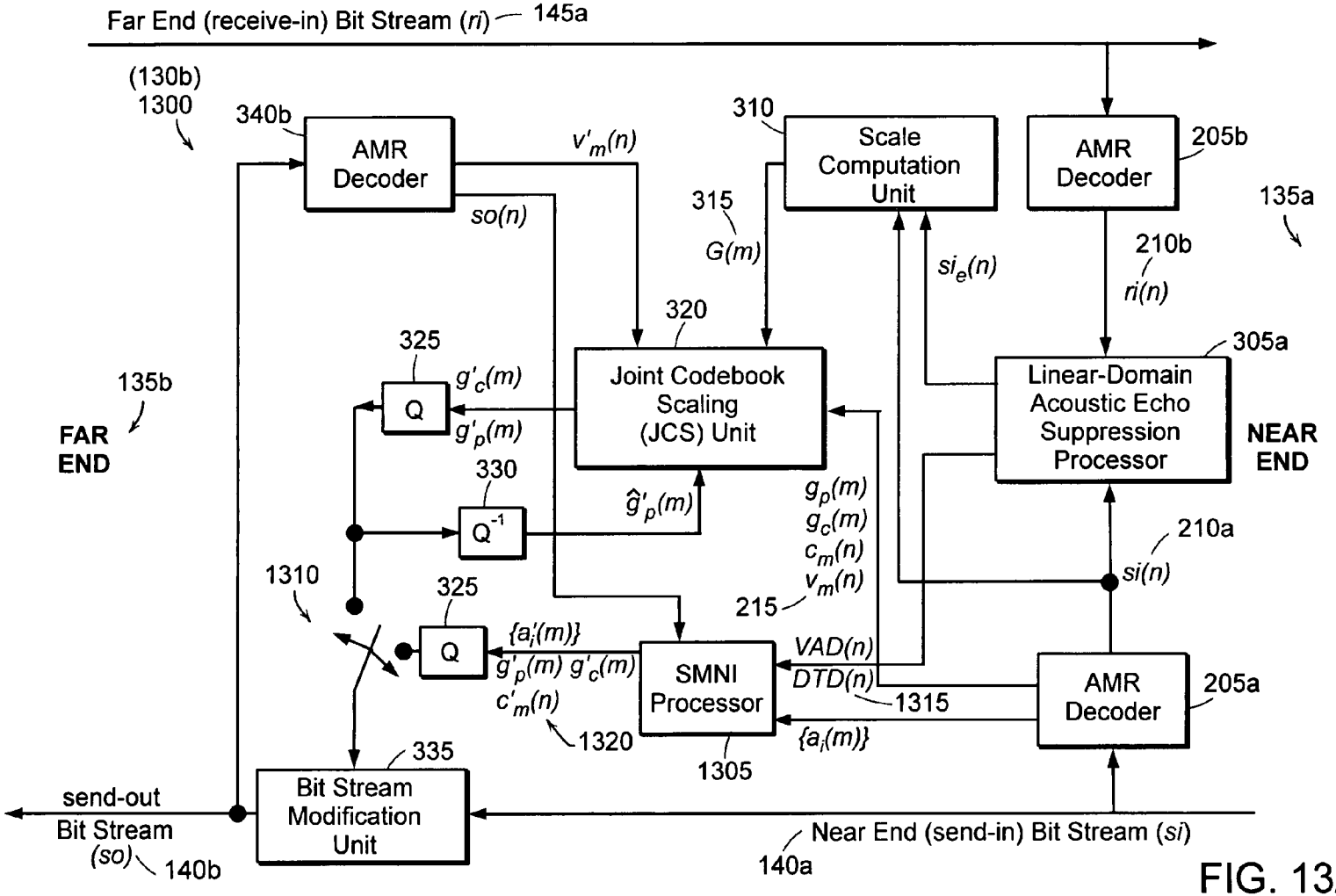
FIG. 13A is a detailed block diagram corresponding to the CD-AES system of FIG. 7A further including Spectrally Matched Noise Injection (SMNI)

FIG. 13A is a block diagram of another exemplary embodiment of a CD-AES system 1300 that can be used to implement the CD-AES system 130*b* of FIGS. 4 and 7A. The Coded Domain Acoustic Echo Suppressor 1300 of FIG. 13A includes an SMNI processor 1305. The idea of the coded domain SMNI is to compute near end background noise spectral characteristics by averaging an amplitude spectrum represented by the LPC coefficients during periods when neither speaker (i.e., near-end and far-end) is speaking. Specifically, the CD-SMNI processor 1305 computes new $\{a_i(m)\}$, $c_m(n)$, $g_c(m)$, and $g_p(m)$ parameters 1320 when the signal 140*a* is to be heavily suppressed.

The inputs to the CD-SNMI processor 1305 are as follows:

(i) the decoded LPC coefficients $\{a_i(m)\}$;

(ii) the decoded fixed codebook vector $c_m(n)$;

(iii) The decoded send-out speech signal, so(n);

(iv) a Voice Activity Detector signal, VAD(n), which is typically determined as part of the Linear-Domain Echo Suppression. This signal indicates whether the near end is speaking or not; and (v) a Double Talk Detector signal, DTD(n), which is typically determined as part of the Linear-Domain Echo Suppression 305*a*. This signal indicates whether both near-end and far-end speakers 105*a*, 105*b* are talking at the same time.

During frames when both VAD(n) and DTD(n) 1315 indicate no activity, implying no speech on either end of the call, the CD-SMNI processor 1305 computes a running average of the spectral characteristics of the signal 140*a*. The technique used to compute the spectral characteristics may be similar to the method used in a standard AMR codec to compute the background noise characteristics for use in its silence suppression feature. Basically, in the AMR codec, the LPC coefficients, in the form of line spectral frequencies, are averaged using a leaky integrator with a time constant of eight frames. The decoded speech energy is also averaged over the last eight frames. In the CD-SMNI processor 1305, a running average of the line spectral frequencies and the decoded speech energy is kept over the last eight frames of no speech activity on either end. When the CD-AES heavily suppresses the signal 140*a* (e.g., by more than 10 dB), the SMNI processor 1305 is activated to modify the send-in bit stream 140*a* and send, by way of a switch 1310 (which may be mechanical, electrical, or software), new coder parameters 1320 so that, when decoded at the far end, spectrally matched noise is injected. This noise injection is similar to the noise injection done during a silence insertion feature of the standard AMR decoder.

When noise is to be injected, the CD-SMNI processor 1305 determines new LPC coefficients, $\{a'_i(m)\}$, based on the above mentioned averaging. Also, a new fixed codebook vector, $c'_m(n)$, and a new fixed codebook gain, $g'_c(m)$, are computed. The fixed codebook vector is determined using a random sequence, and the fixed codebook gain is determined based on the above mentioned decoded speech energy. The adaptive codebook gain, $g'_p(m)$, is set to zero. These new parameters 1320 are quantized 325 and inserted 335 into the send-in bit stream 140*a* to produce the send-out bit stream 140*b*.

Note that, in contrast to FIG. 7A, the decoder 340*b* operating on the send-out bit stream, so, 140*b* in FIG. 13A is no longer a partial decoder since SMNI needs to have access to the decoded speech signal. However, since the decoded speech is used to compute its energy, the AMR decoder 340*b* can be partial in the sense that post-filtering need not be performed.

Figures 1, 13B:
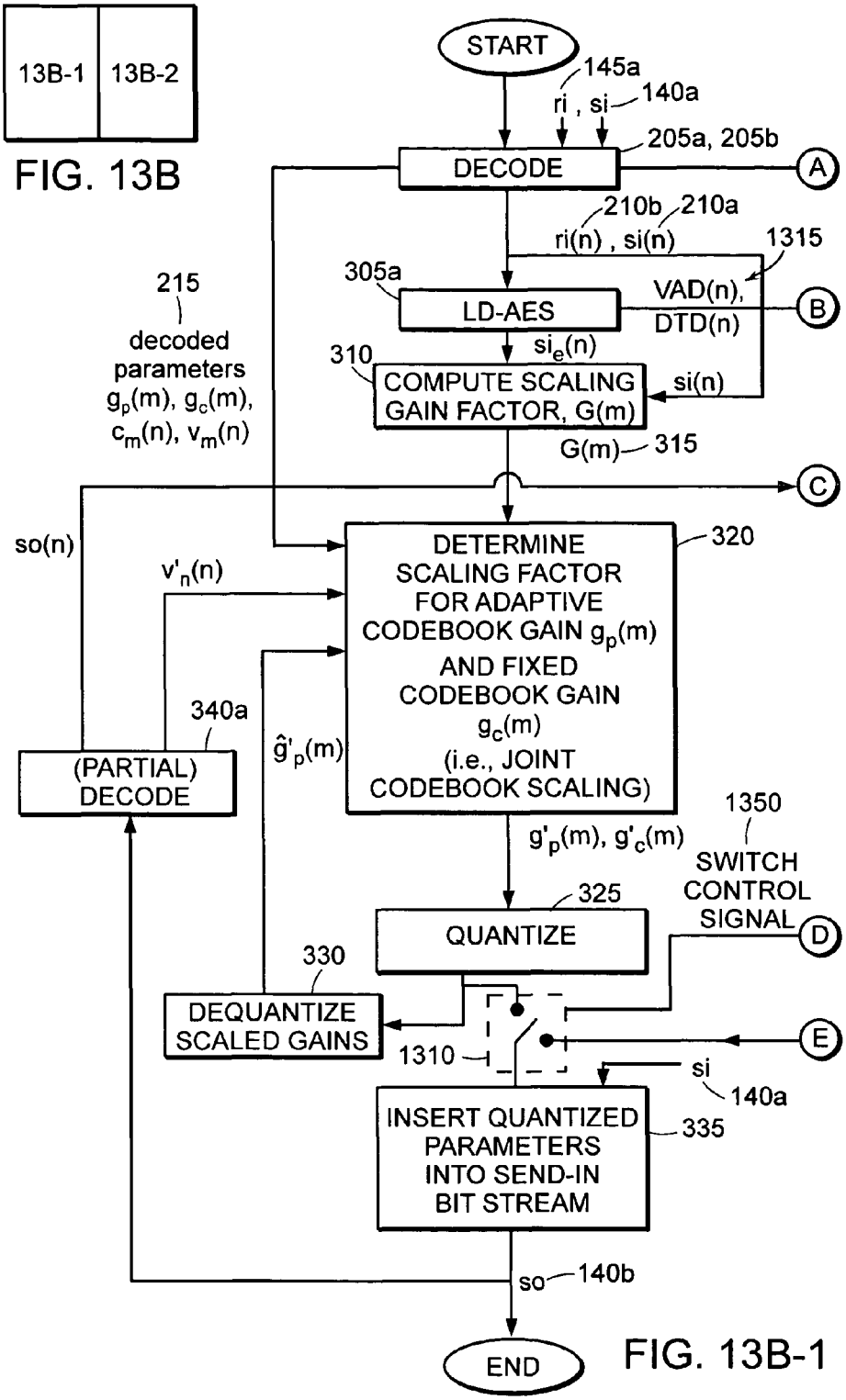
FIG. 13B is a flow diagram corresponding to the CD-AES system of FIG. 13A.
Figures 2, 13B:
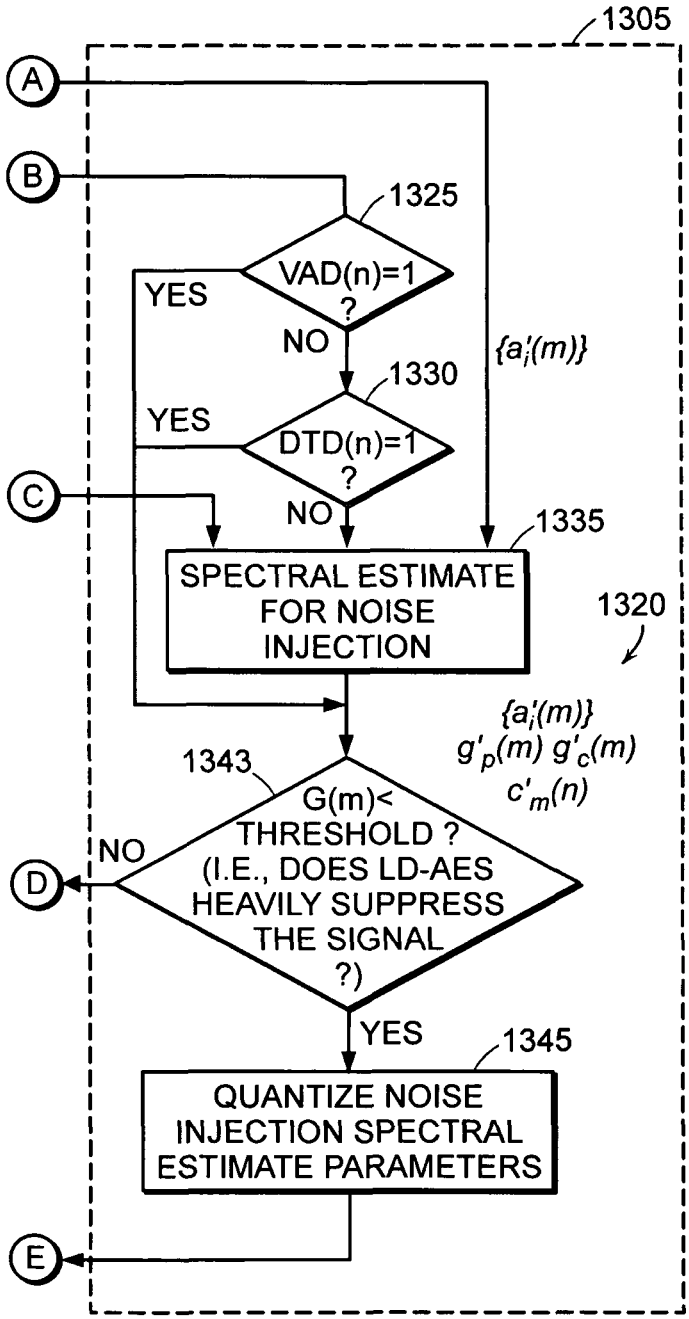

FIG. 13B is a flow diagram corresponding to the CD-AES system of FIG. 13A. In the flow diagram, example internal activities occurring in the SMNI processor 1305 are illustrated, which include a determination 1325 as to whether voice activity is detected and a determination 1330 whether double talk is present (i.e., whether both users 105*a*, 105*b* are speaking concurrently). If both determinations 1325, 1330 are false (i.e., there is silence on the line), then a spectral estimate for noise injection 1335 is updated. Thereafter, a determination 1340 as to whether the LD-AES heavily suppresses the signal is made. If it does, then the noise injection spectral estimate parameters are quantized 1345, and the switch 1310 is activated by a switch control signal 1350 to pass the quantized noise injection parameters. If the LD-AES does not heavily suppress the signal, then the switch 1310 allows the quantized, adaptive and fixed codebook gains that are determined by the JCS process to pass.

Coded Domain Noise Reduction (CD-NR)

A method and corresponding apparatus for performing noise reduction directly in the coded domain using an exemplary embodiment of the present invention is now described. As should become clear, no intermediate decoding/re-encoding is performed, thereby avoiding speech degradation due to tandem encodings and also avoiding significant additional delays.

Figure 14:
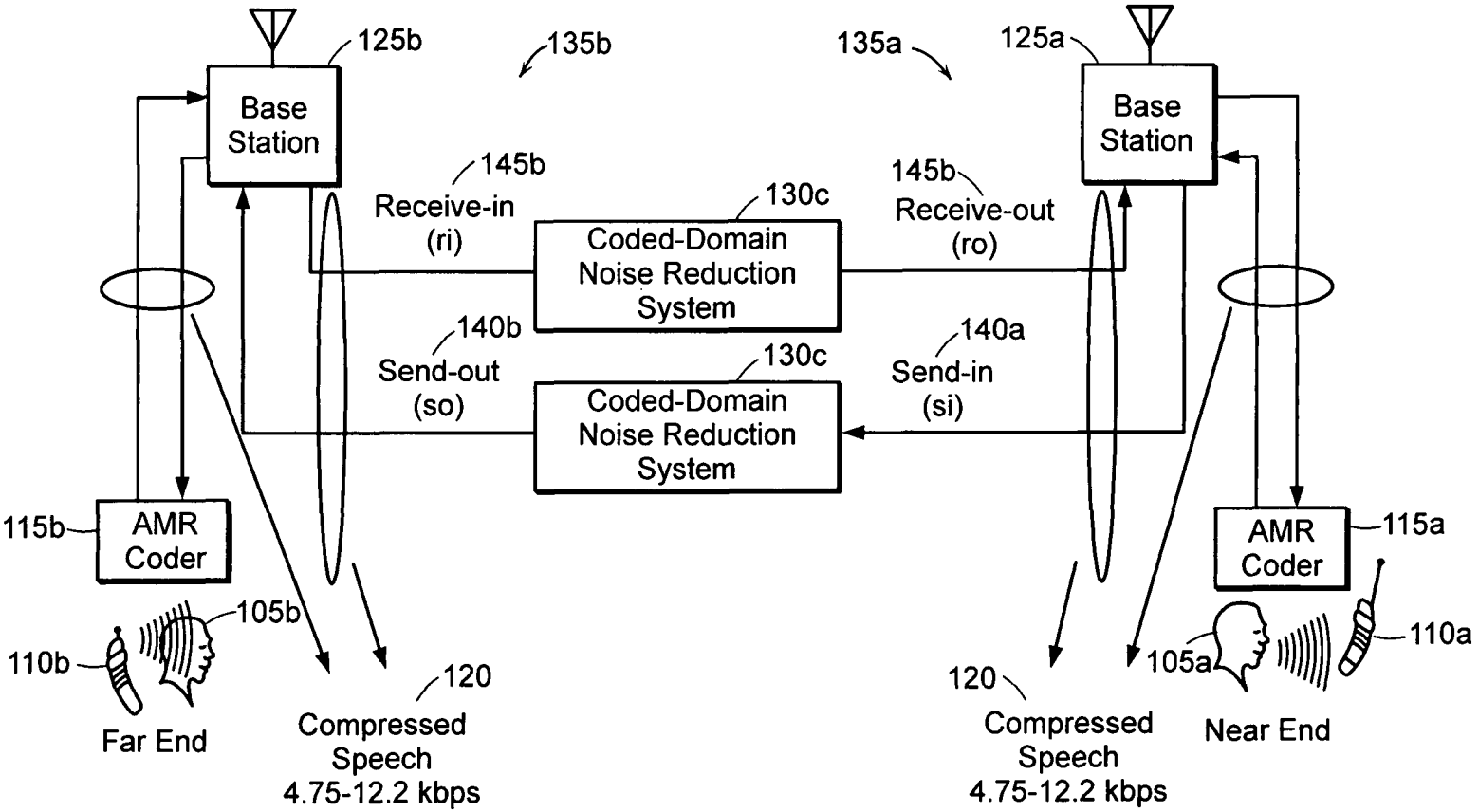
FIG. 14 is a network diagram including a Coded Domain Noise Reduction (CD-NR) system optionally included in the CD-VQE system of FIG. 1.

FIG. 14 is a block diagram of the network 100 employing a Coded Domain Noise Reduction (CD-NR) system 130*c*, where noise reduction is shown on both sides of the call. One side of the call is referred to herein as the near end 135*a*, and the other side of the call is referred to herein as the far end 135*b*. In this figure, the receive-in signal, ri, 145*a*, the send-in signal, si, 140*a*, and the send-out signal, so, 140*b* are bit streams representing compressed speech. Since the two noise reduction systems 130*c* are identical in operation, the description below focuses on the noise reduction system 130*c* that operates on the send-in signal, si, 140*a*.

The CD-NR system 130*c* presented herein is applicable to the family of speech coders based on Code Excited Linear Prediction (CELP). According to an exemplary embodiment of the present invention, the AMR set of coders is considered an example of CELP coders. However, the method for CD-NR presented herein is directly applicable to all coders based on CELP. Moreover, although the VQE processors described herein are presented in reference to CELP-based systems, the VQE processors are more generally applicable to any form of communications system or network that codes and decodes communications or data signals in which VQE processors or other processors can operate in the coded domain.

Three different methods of Coded Domain Noise Reduction are presented immediately below.

Method 1

A Coded Domain Noise Reduction method and corresponding apparatus is described herein whose performance approximates the performance of a Linear Domain-Noise Reduction technique. To accomplish this performance, after performing Linear-Domain Noise Reduction (LD-NR), the CD-NR system 130*c* extracts relevant information from the LD-NR processor. This information is then passed to a coded domain noise reduction processor.

Figure 15:
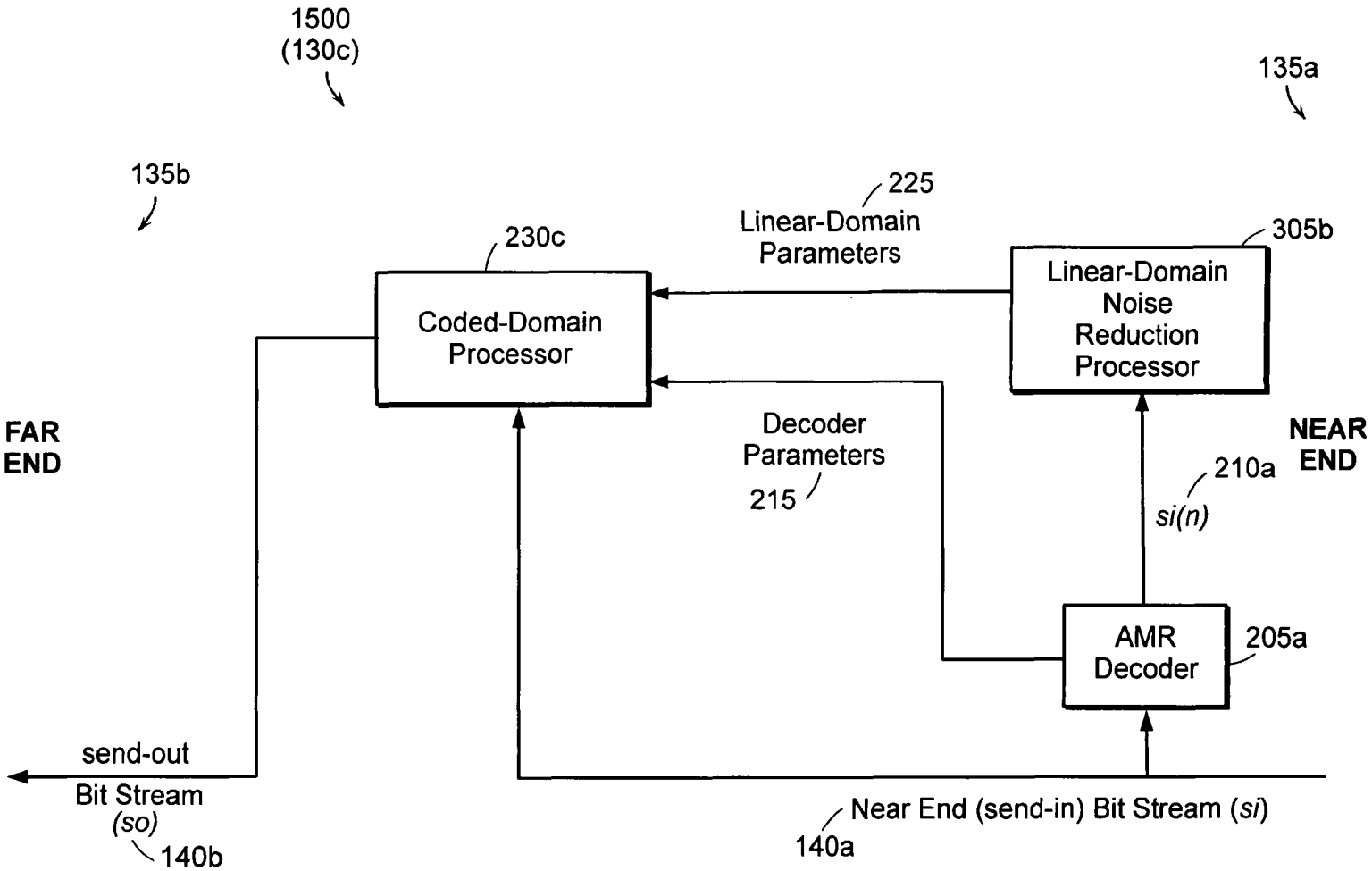
FIG. 15 is a high level block diagram of the CD-NR system of FIG. 14.

FIG. 15 is a high level block diagram of the approach taken. An exemplary CD-NR system 1500 may be used to implement the CD-NR system 130*c* introduced in FIG. 14. In FIG. 15, only the near-end side 135*a* of the call is shown, where noise reduction is performed on the send-in bit stream, si, 140*a*. The send-in bit stream 140*a* is decoded into the linear domain, si(n), 210*a* and then passed through a conventional LD-NR system 305*b* to reduce the noise in the si(n) signal 210*a*. Relevant information 215, 225 is extracted from both LD-NR and the AMR decoding processors 305*b*, 205*a*, and then passed to the coded domain processor 1500. The coded domain processor 1500 modifies the appropriate parameters in the si bit stream 140*a* to effectively reduce noise in the signal.

It should be understood that the AMR decoding 205*a* can be a partial decoding of the send-in signal 140*a*. For example, since LD-NR is typically concerned with noise estimation and reduction, the post-filter present in the AMR decoder 205*a* need not be implemented. It should further be understood that, although the si signal 140*a* is decoded 205*a* into the linear domain, no intermediate decoding/re-encoding, which can degrade the speech quality, is being introduced. Rather, the decoded signal 210*a* is used to extract relevant information 225 that aids the coded domain processor 1500 and is not re-encoded after the LD-NR processor 305*b* is performed.

Figure 16A:
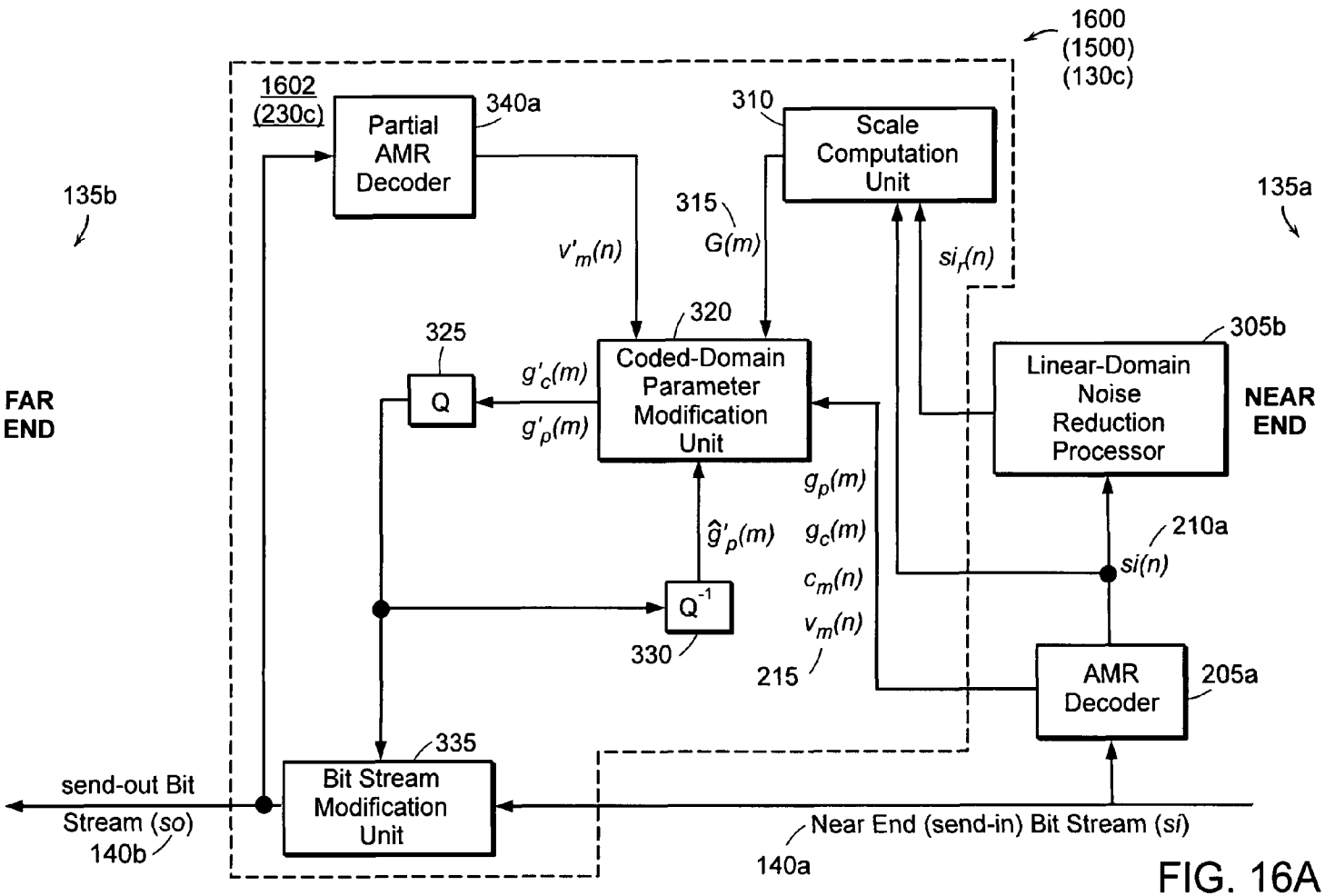
FIG. 16A is a detailed block diagram of the CD-NR system of FIG. 15 using a first method.

FIG. 16A shows a detailed block diagram of another exemplary embodiment of a CD-NR system 1600 used to implement the CD-NR systems 130*c* and 1500. Typically, the LD-NR system 305*b* decomposes the signal into its frequency-domain components using a Fast Fourier Transform (FFT). In most implementations, the frequency components range between 32 and 256. Noise is estimated in each frequency component during periods of no speech activity. This noise estimate in a given frequency component is used to reduce the noise in the corresponding frequency component of the noisy signal. After all the frequency components have been noise reduced, the signal is converted back to the time-domain via an inverse FFT.

An important observation about the Linear Domain Noise Reduction is that if a comparison of the energy of the original signal si(n) 210*a* to the energy of the noise reduced signal $Si_r(n)$ is made, one finds that different speech segments are scaled differently. For example, segments with high Signal-to-Noise Ratio (SNR) are scaled less than segments with low SNR. The reason for that lies in the fact that noise reduction is being done in the frequency domain. It should be understood that the effect of LD-NR in the frequency domain is more complex than just segment-specific time-domain scaling. But, one of the most audible effects is the fact that the energy of different speech segments are scaled according to their SNR. This gives motivation to the CD-NR using an exemplary embodiment of the present invention, which transforms the problem of Noise Reduction in the coded domain to one of adaptively scaling the signal.

The scaling factor 315 for a given frame is the ratio between the energy of the noise reduced signal, $Si_r(n)$, and the original signal, si(n) 210*a*. The "Coded Domain Parameter Modification" unit 320 in FIG. 16A is the Joint Codebook Scaling (JCS) method described above. In JCS, both the CELP adaptive codebook gain, $g_p(m)$, and the fixed codebook gain, $g'_c(m)$, are scaled. They are then quantized 325 and inserted 335 in the send-out bit stream, so, 140*b* replacing the original gain parameters present in the si bit stream 140*a*. These scaled gain parameters, when used along with the other decoder parameters 215 in the AMR decoding processor 205*a*, produce a signal that is an adaptively scaled version of the original noisy signal, si(n), 210*a*, which produces a reduced noise signal approximating the reduced noise, linear domain signal, $si_r(n)$, which may be referred to as a target signal.

Figure 16B:
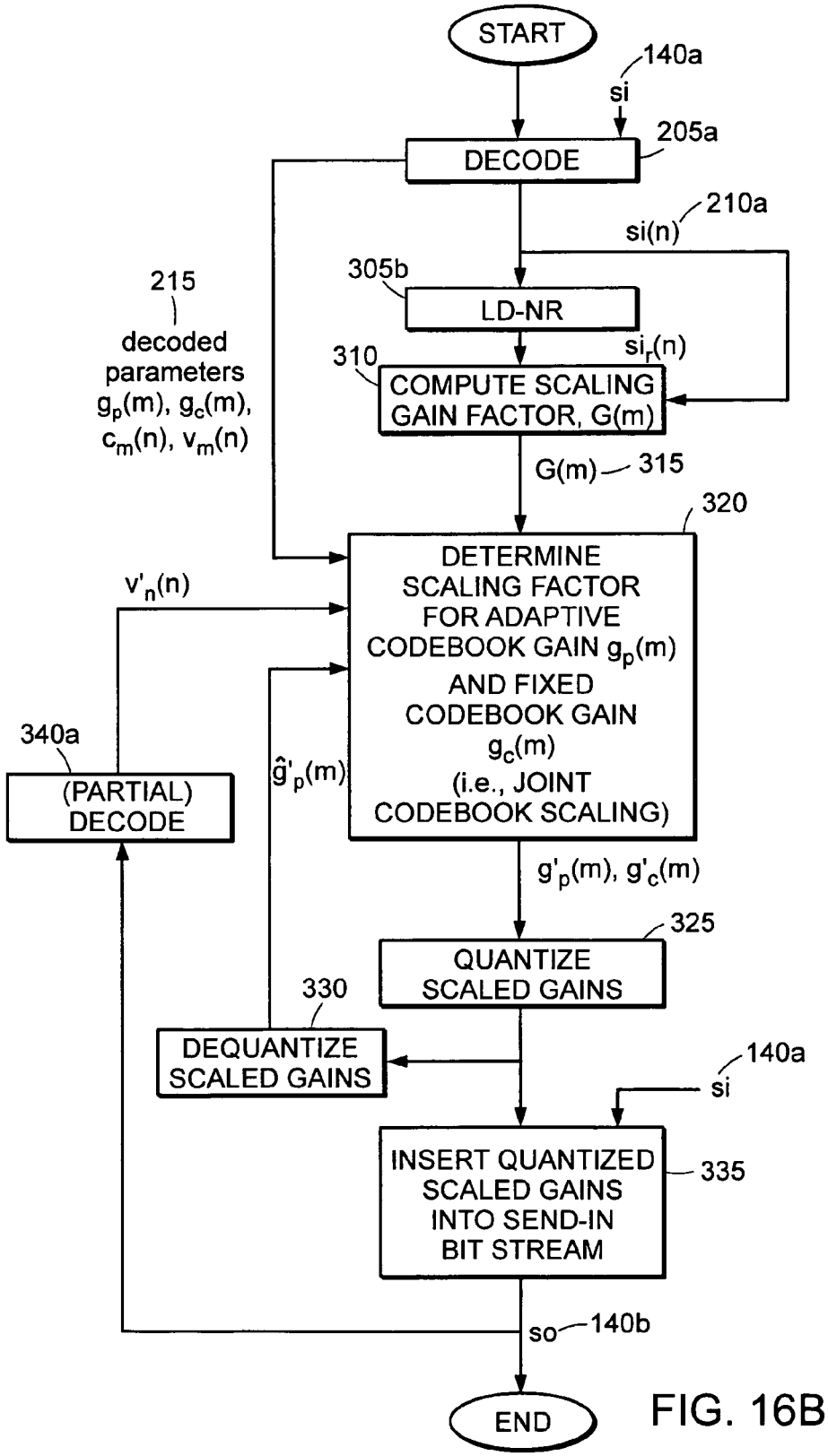
FIG. 16B is a flow diagram corresponding to the CD-NR system of FIG. 16A.

Below is a summary of the operations in the proposed CD-NR system 1600 shown in FIG. 16A and presented in the form of a flow diagram in FIG. 16B:

(i) The bit stream si 140*a* is decoded into a linear domain signal, si(n) 210*a*.

(ii) A Linear-Domain Noise Reduction system 305*b* that operates on si(n) 210*a* is performed. The LD-NR output is the signal si, (n), which represents the send-in signal, si(n), 210*a* after noise is reduced and may be referred to as the target signal.

(iii) A scale computation 310 that determines the scaling factor 315 between si(n) 210*a* and $Si_r(n)$ is performed. A single scaling factor, G(m), 315 is computed for every frame (or subframe) by buffering a frame worth of samples of si(n) 210*a* and $Si_r(n)$ and determining the ratio between them. Here, the index, m, is the frame number index. One possible method for computing G(m) 315 is a simple power ratio between the two signals in a given frame. Other methods include computing a ratio of the absolute value of every sample of the two signals in a frame, and then taking a median or average of the sample ratio for the frame, and assigning the result to G(m) 315. The scale factor 315 can be viewed as the factor by which a given frame of si(n) 210*a* has to be scaled to reduce the noise in the signal. The frame duration of the scale computation is equal to the subframe duration of the CELP coder. For example, in the AMR 12.2 kbps coder 205*a*, the subframe duration is 5 msec. The scale computation frame duration is therefore set to 5 msec.

(iv) The scaling factor, G(m), 315 is used to determine a scaling factor for both the adaptive codebook gain and the fixed codebook gain parameters of the coder. The Coded-Domain Parameter Modification unit 320 employs the Joint Codebook Scaling method to scale $g_p(m)$ and $g_c(m)$.

(v) The scaled gains are quantized 325 and inserted 335 into the send-out bit stream, so, 140*b* by substituting the original quantized gains in the si bit stream 140*a*.

Method 2

Figure 17A:
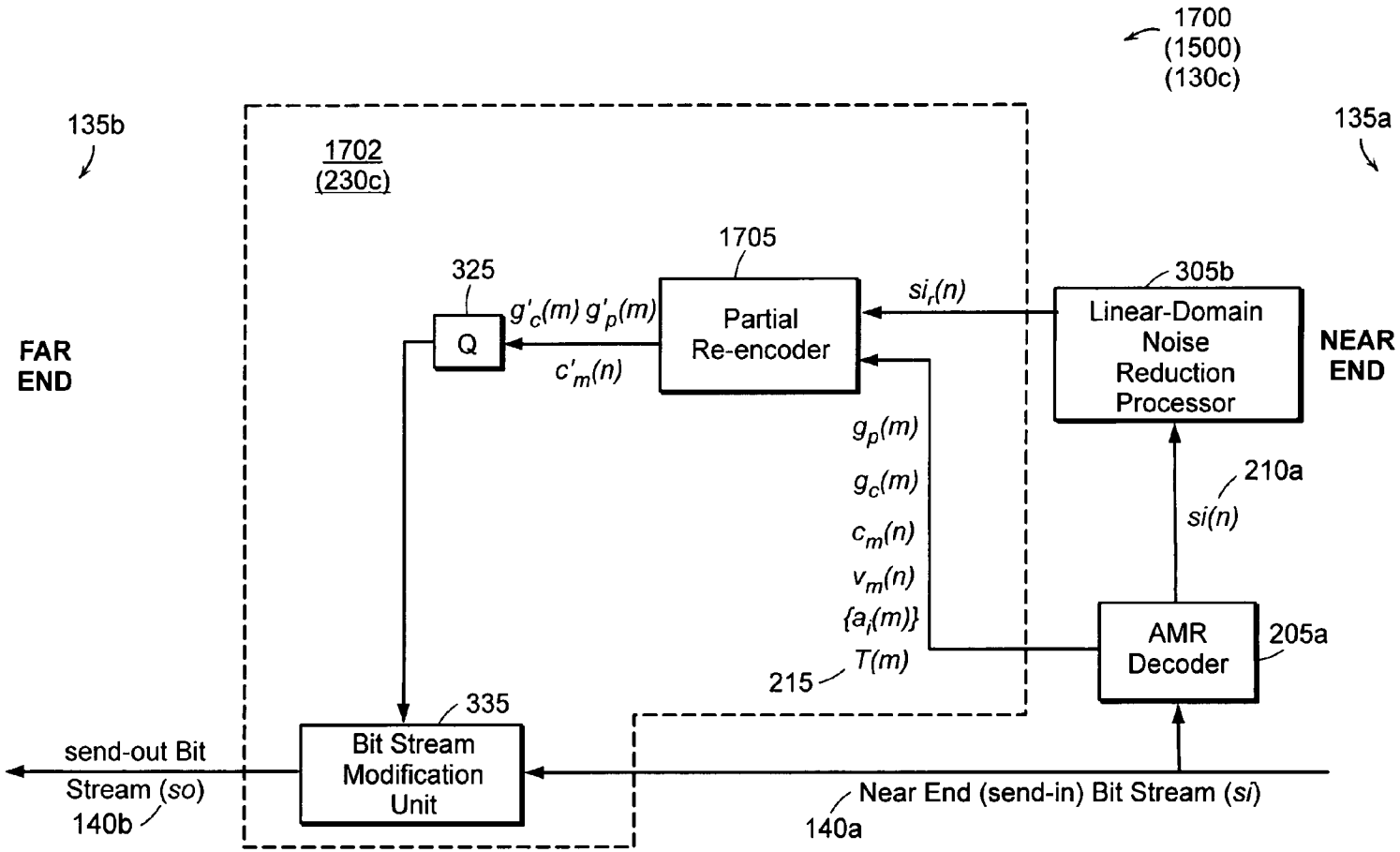
FIG. 17A is a detailed block diagram of the CD-NR system of FIG. 15 using a second method.

FIG. 17A is a block diagram illustrating another exemplary embodiment of a CD-NR system 1700 used to implement the CD-NR systems 130*c*, 1500. In this embodiment, the linear domain noise-reduced signal, $Si_r(n)$, is re-encoded by a partial re-encoder 1705. However, the re-encoding is not a full re-encoding. Rather, it is partial in the sense that some of encoded parameters in the send-in signal bit stream, si, 140*a* are kept, while others are re-estimated and re-quantized. In one example implementation, the LPC parameters, {a'(m)}, and the pitch lag value, T(m), are kept the same as what is contained in the si bit stream 140*a*. The adaptive codebook gain, $g_p(m)$, the fixed codebook vector, $c_m(n)$, and the fixed codebook gain, $g_c(m)$, are re-estimated, re-quantized, and then inserted into the send-out bit stream, so, 140*b*. Re-estimating these parameters is the same process used in the regular AMR encoder. The difference is that, in the re-encoding processor 1705, the LPC parameters, {a'(m)}, and the pitch lag value, T(m), are not re-estimated but assigned the specific values corresponding to the si bit stream 140*a*. As such, this re-encoding 1705 is a partial re-encoding.

Figure 17B:
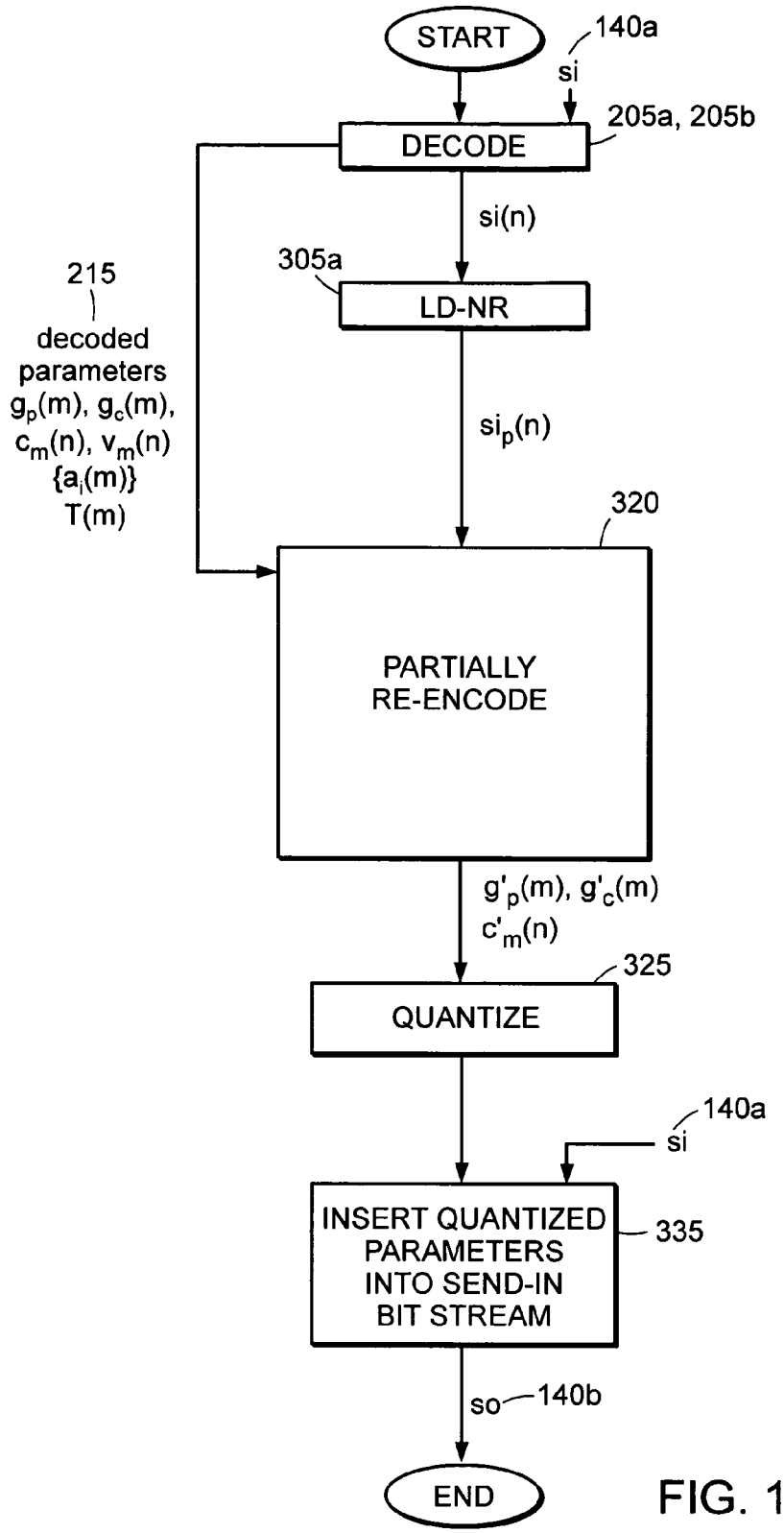
FIG. 17B is a flow diagram corresponding to the CD-NR system of FIG. 17A.

FIG. 17B is a flow diagram of a method corresponding to the embodiment of the CD-NR system 1700 of FIG. 7A.

Method 3

Comparing Method 1 to Method 2 for CD-NR, it is noted that one of the major differences between them is that the fixed codebook vector, $c_m(n)$, is re-estimated in Method 2. This re-estimation is performed using a similar procedure to how $c_m(n)$ is estimated in the standard AMR encoder. It is well known, however, that the computational requirements needed for re-estimating $c_m(n)$ is rather large. It is also useful to note that at relatively medium to high Signal-to-Noise Ratio (SNR), the performance of Method 1 matches very closely the performance of the Linear Domain Noise Reduction system. At relatively low SNR, there is more audible noise in the speech segments of Method 1 compared to the LD-NR system 305*b*. Method 2 can reduce this noise in the low SNR cases. One way to incorporate the advantages of Method 2, without the full computational requirements needed for Method 2, is to combine Method 1 and 2 in the following way. A byproduct of most Linear-Domain Noise Reduction is an on-going estimate of the Signal-to-Noise Ratio of the original noisy signal. This SNR estimate can be generated for every subframe. If it is detected that the SNR is medium to large, follow the procedure outlined in Method 1. If it is detected that the SNR is relatively low, follow the procedure outlined in Method 2.

Coded Domain Adaptive Level Control (CD-ALC)

A method and corresponding apparatus for performing adaptive level control directly in the coded domain using an exemplary embodiment of the present invention is now presented. As should become clear, no intermediate decoding/re-encoding is performed, thus avoiding speech degradation due to tandem encodings and also avoiding significant additional delays.

Figure 18:
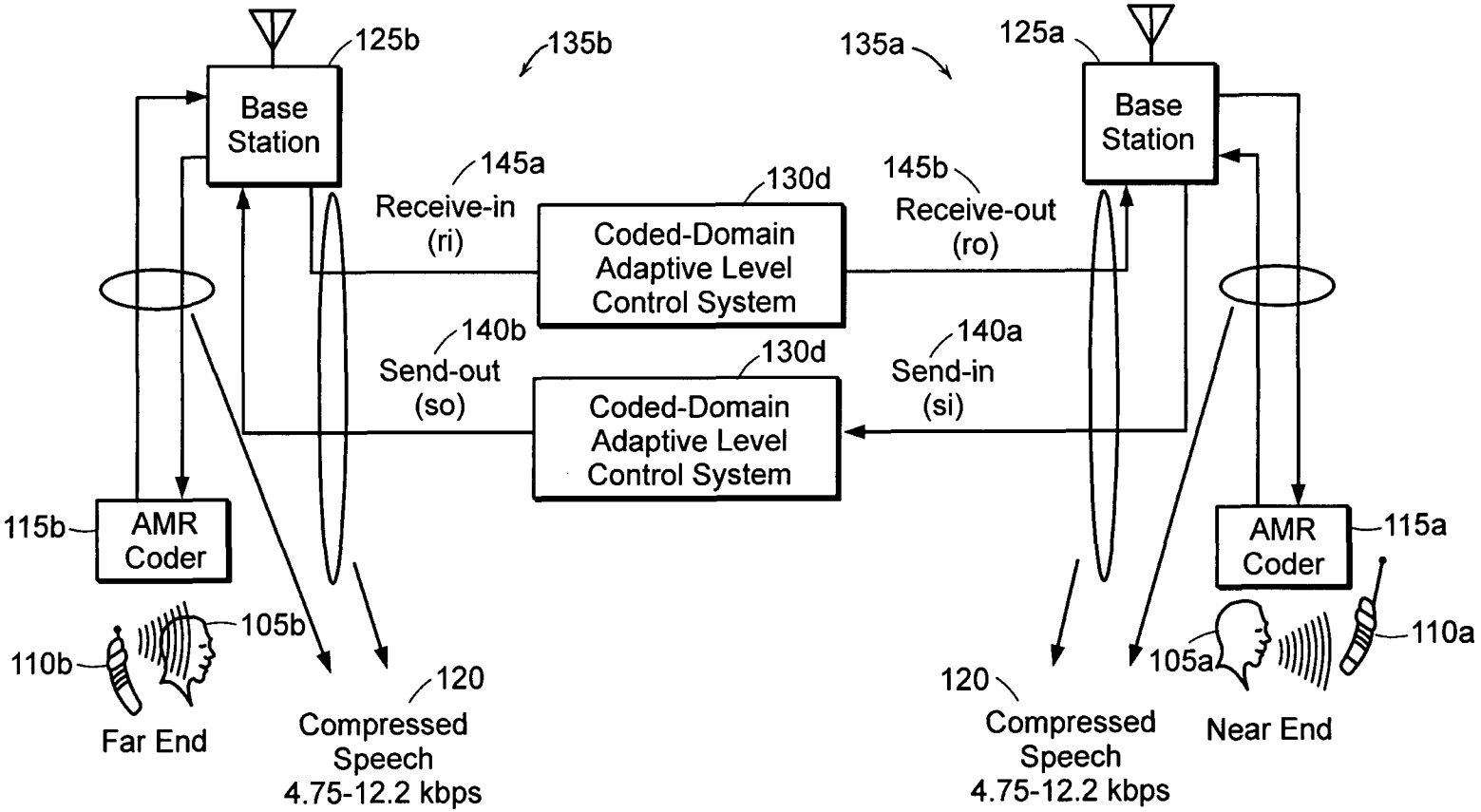
FIG. 18 is a block diagram of a network employing a Coded Domain Adaptive Level Control (CD-ALC) optionally provided in the CD-VQE system of FIG. 1.

FIG. 18 is a block diagram of the network 100 employing a Coded Domain Adaptive Level Control (CD-ALC) system 130*d* using an exemplary embodiment of the present invention, where the adaptive level control is shown on both sides of the call. One side of the call is referred to herein at the near end 135*a* and the other side is referred to herein as the far end 135*b*. In this figure, the receive-in signal, ri, 145*a*, the send-in signal, si, 140*a*, and the send-out signal, so, 140*b* are bit streams representing compressed speech. Since the two adaptive level control systems 130*d* are identical in operation, the description below focuses on the CD-ALC system 130*d* that operates on the send-in signal, si, 140*a*.

The CD-ALC method and corresponding apparatus presented herein is applicable to the family of speech coders based on Code Excited Linear Prediction (CELP). According to an exemplary embodiment of the present invention, the AMR set of coders is considered as an example of CELP coders. However, the method and corresponding apparatus for CD-ALC presented herein is directly applicable to all coders based on CELP.

A Coded Domain Adaptive Level Control method and corresponding apparatus are described herein whose performance matches the performance of a corresponding Linear-Domain Adaptive Level Control technique. To accomplish this matching performance, after performing Linear-Domain Adaptive Level Control (LD-ALC), the CD-ALC system 130*d* extracts relevant information from the LD-ALC processor 305*c*. This information is then passed to the Coded Domain Adaptive Level Control system 130*d*.

Figure 19:
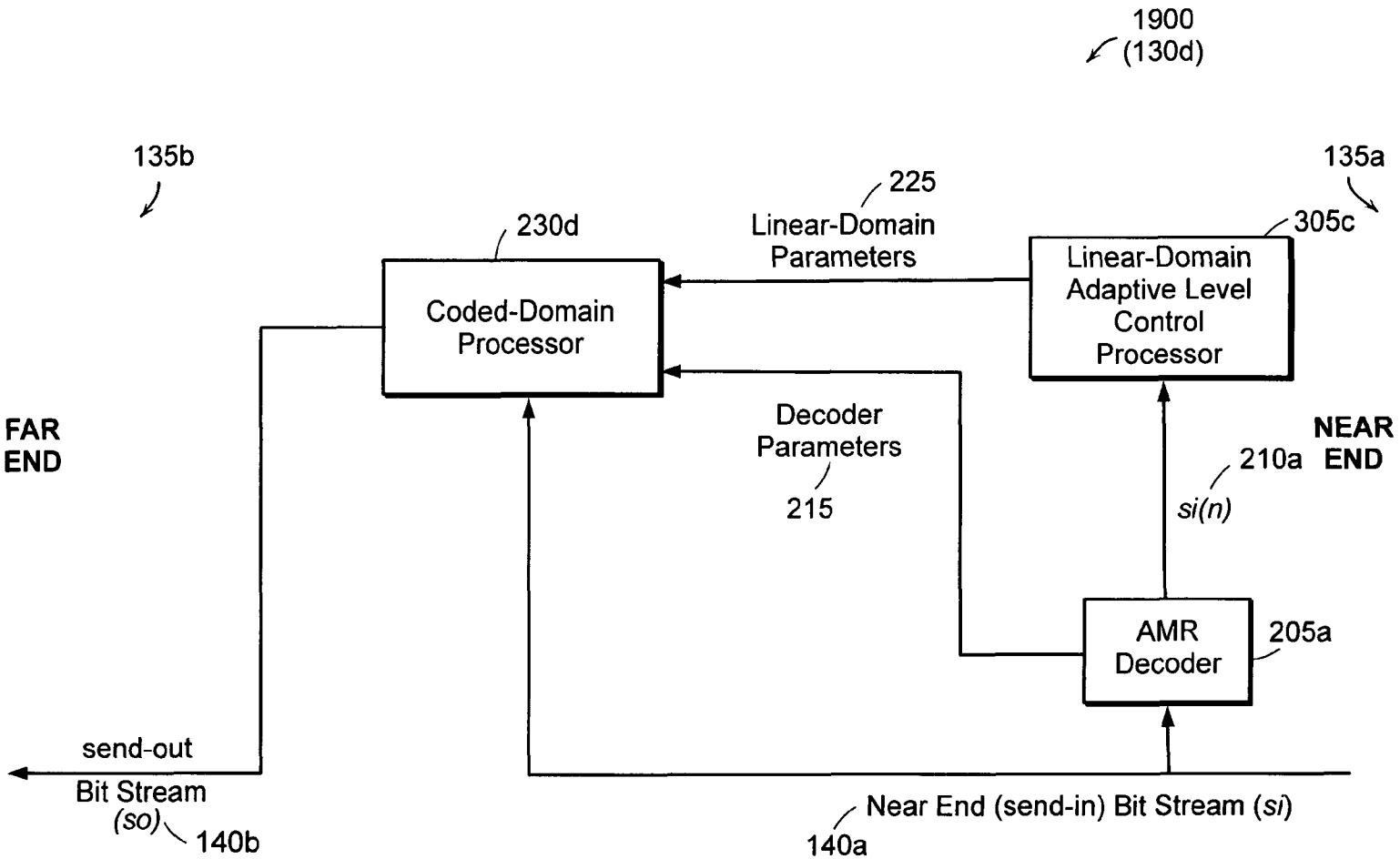
FIG. 19 is a high level block diagram of the CD-ALC system of FIG. 18.

FIG. 19 shows a high level block diagram of an exemplary embodiment of a CD-ALC system 1900 that can be used to implement the CD-ALC system of FIG. 18. In FIG. 19, only the near-end side 135*a* of the call is shown, where Adaptive Level Control is performed on the send-in bit stream, si, 140*a*. The send-in bit stream 140*a* is decoded into the linear domain, si(n), 210*a* and then passed through a conventional LD-ALC system 305*c* to adjust the level of the si(n) signal 210*a*. Relevant information 225, 215 is extracted from both LD-ALC and the AMR decoding processors 305*c*, 205*a*, and then passed to the coded domain processor 230*d*. The coded domain processor 230*d* modifies the appropriate parameters in the si bit stream 140*a* to effectively reduce noise in the signal.

It should be understood that the AMR decoding 205*a* can be a partial decoding of the send-in bit stream signal 140*a*. For example, since LD-ALC processor 305*c* is typically concerned with determining signal levels, the post-filter present in the AMR decoder 205*a* need not be implemented. It should further be understood that, although the si signal 140*a* is decoded into the linear domain, no intermediate decoding/re-encoding, which can degrade the speech quality, is being introduced. Rather, the decoded signal 210*a* is used to extract relevant information 215, 225 that aids the coded domain processor 230*d* and is not re-encoded after the LD-ALC processor 1900.

Figure 20A:
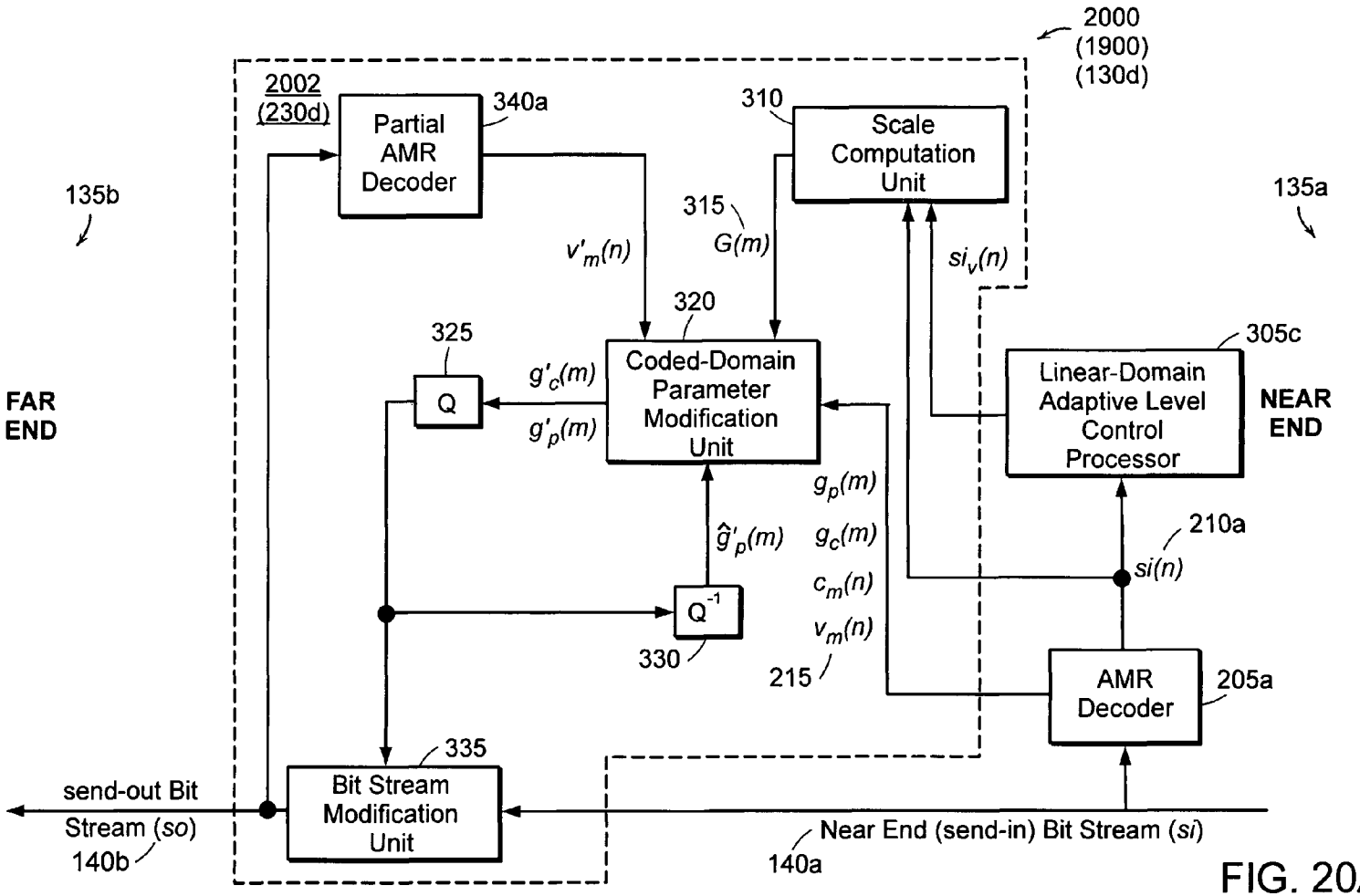
FIG. 20A is a detailed block diagram of the CD-ALC system of FIG. 19.

FIG. 20A is a detailed block diagram of an exemplary embodiment of a CD-ALC system 2000 that can be used to implement the CD-ALC systems 130*d*, 1900. The CD-ALC system 2000 also includes an embodiment of a coded domain processor 2002 introduced as the coded domain processor 230*d* in FIGS. 2 and 19. Typically, the LD-ALC system 305*c* determines an adaptive scaling factor 315 for the signal on a frame by frame basis, so the problem of Adaptive Level Control in the coded domain is transformed to one of adaptively scaling the signal 140*a*. The scaling factor 315 for a given frame is determined by the LD-ALC processor 305*c*. The "Coded Domain Parameter Modification" unit 320 in FIG. 20A may be the Joint Codebook Scaling (JCS) method described above. In JCS, both the CELP adaptive codebook gain and the fixed codebook gain are scaled. They are then quantized 325 and inserted 335 in the send-out bit stream, so, 140*b*, replacing the original gain parameters present in the si bit stream 140*a*. These scaled gain parameters, when used along with the other decoder parameters 215 in the AMR decoding processor 205*a*, produce a signal that is an adaptively scaled version of the original signal, si(n), 210*a*.

Figure 20B:
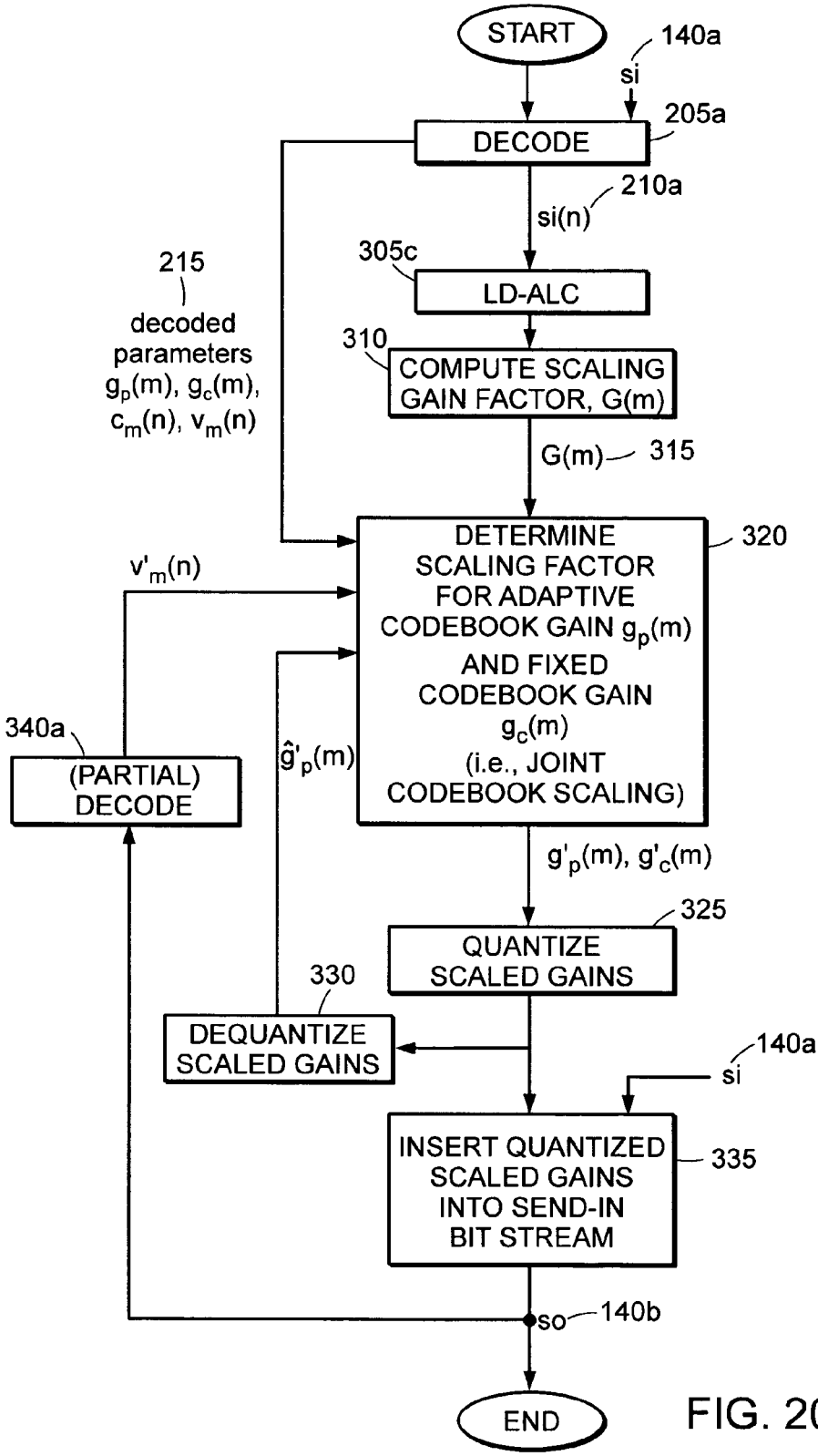
FIG. 20B is a flow diagram corresponding to the CD-ALC system of FIG. 20A.

The operations in the CD-ALC system 2000 shown in FIG. 20A are summarized immediately below and presented in flow diagram form in FIG. 20B:

(i) The bit stream si is decoded into the linear signal, si(n).

(ii) A Linear-Domain Adaptive Level Control system 305*c* that operates on si(n) is performed. The LD-ALC output is the signal $si_v(n)$ which represents the send-in signal, si(n), 210*a* after adaptive level control and may be referred to as the target signal.

(iii) A scale computation 310 that determines the scaling factor 315 between si(n) 210*a* and $si_v(n)$ is performed. A single scaling factor, G(m), 315 is computed for every frame (or subframe) by buffering a frame worth of samples of si(n) 210*a* and $si_v(n)$ and determining the ratio between them. Here, the index, m, is the frame number index. One possible method for computing G(m) 315 is a simple power ratio between the two signals in a given frame. Other methods include computing a ratio of the absolute value of every sample of the two signals in a frame, and then taking a median or average of the sample ratio for the frame, and assigning the result to G(m) 315. The scale factor 315 can be viewed as the factor by which a given frame of si(n) 210*a* has to be scaled to reduce the noise in the signal. The frame duration of the scale computation is equal to the subframe duration of the CELP coder. For example, in the AMR 12.2 kbps coder 205*a*, the subframe duration is 5 msec. The scale computation frame duration is therefore set to 5 msec.

(iv) The scaling factor, G(m), 315 is used to determine a scaling factor for both the adaptive codebook gain and the fixed codebook gain parameters of the coder. The Coded-Domain Parameter Modification unit 320 employs the Joint Codebook Scaling method to scale $g_p(m)$ and $g_c(m)$.

(v) The scaled gains are quantized and inserted into the send-out bit stream, so, 140*b* by substituting the original quantized gains in the si bit stream 140*a*.

Coded Domain Adaptive Gain Control (CD-AGC)

A method and corresponding apparatus for performing adaptive gain control directly in the coded domain using an exemplary embodiment of the present invention is now presented. As should become clear, no intermediate decoding/re-encoding is performed, thus avoiding speech degradation due to tandem encodings and also avoiding significant additional delays.

Figure 21:
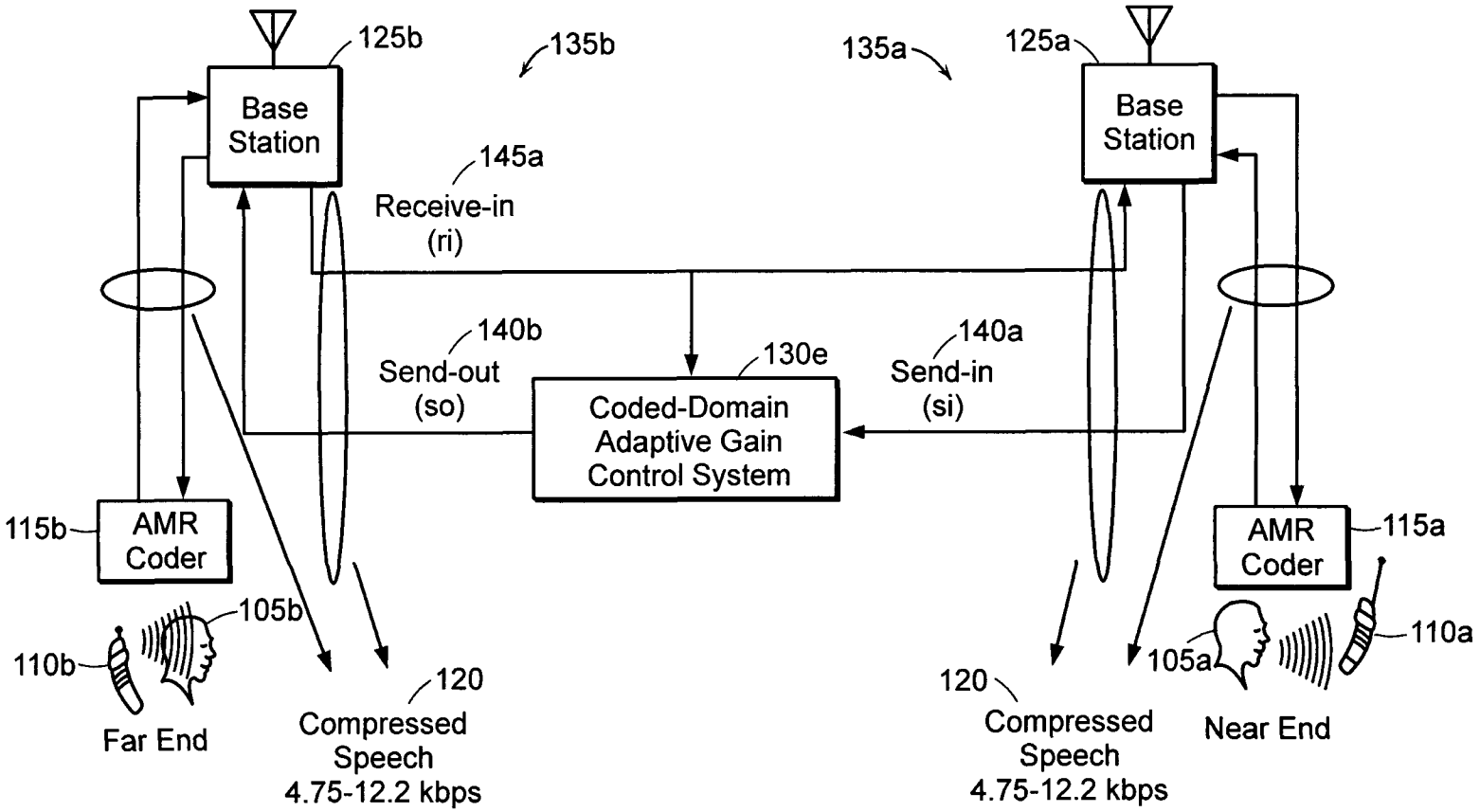
FIG. 21 is a network diagram using a Coded Domain Adaptive Gain Control (CD-AGC) system optionally used in the CD-VQE system of FIG. 1.

FIG. 21 is a block diagram of the network 100 employing a Coded Domain Adaptive Gain Control (CD-AGC) system 130*e*, where the adaptive gain control is shown in one direction. One call side is referred to herein as the near end 135*a*, and the other call side is referred to herein as the far end 135*b*. In this figure, the receive-in signal, ri, 145*a*, the send-in signal, si, 140*a*, and the send out signal, so, 140*b* are bit streams representing compressed speech. Since the adaptive gain control systems 130*e* for both directions are identical in operation, focus herein is on the system 130*e* that operates on the send-in signal, si, 140*a*.

The CD-AGC method and corresponding apparatus presented herein is applicable to the family of speech coders based on Code Excited Linear Prediction (CELP). According to an exemplary embodiment of the present invention, the AMR set of coders is considered as an example of CELP coders. However, the method and corresponding apparatus for CD-AGC presented herein is directly applicable to all coders based on CELP.

Figure 22:
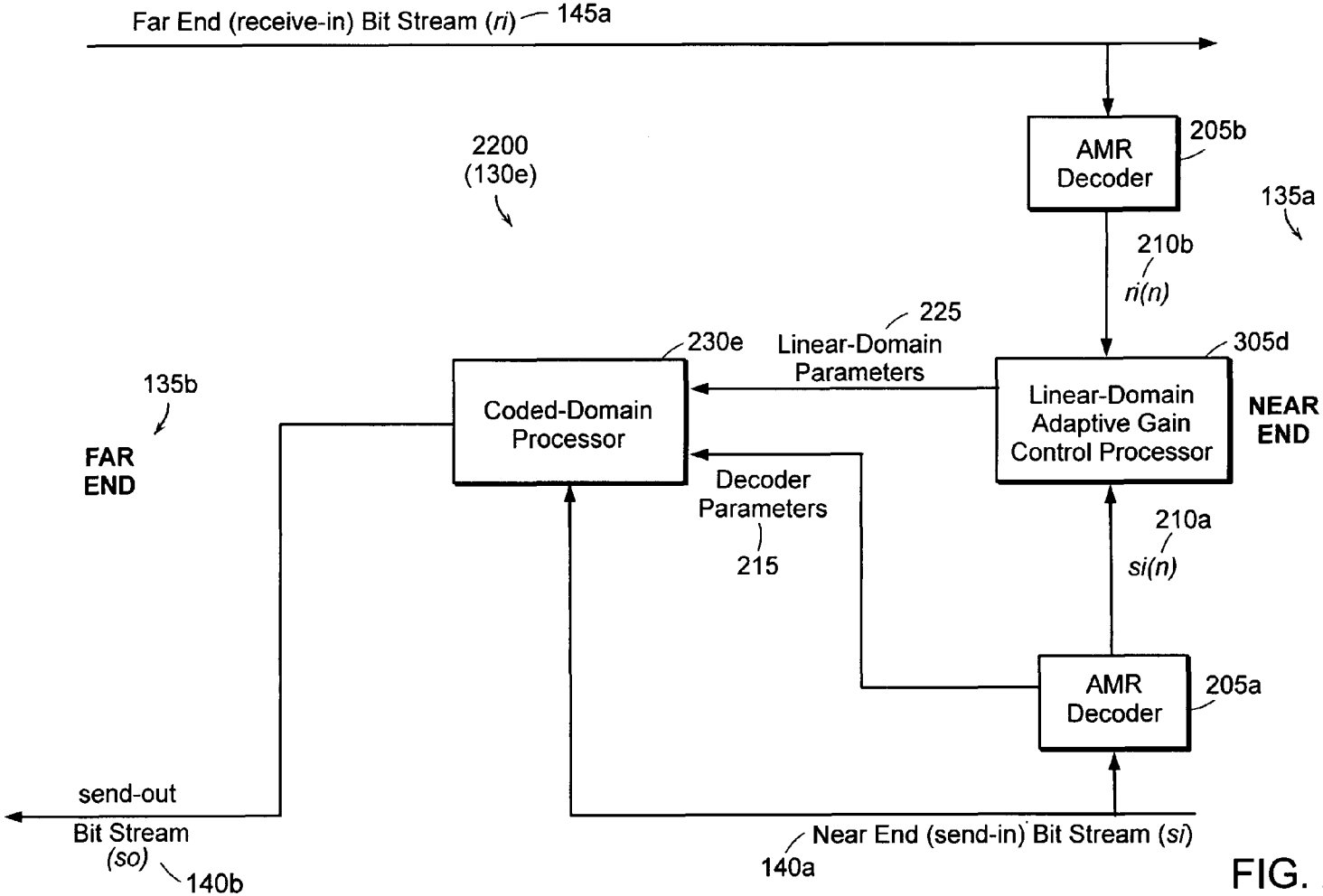
FIG. 22 is a high level block diagram of the CD-AGC system of FIG. 21.

FIG. 22 is a high level block diagram of an exemplary embodiment of an LD-AGC system 2200 used to implement the LD-AGC system 130*e* introduced in FIG. 21. Referring to FIG. 22, the basic approach of the method and corresponding apparatus for Coded Domain Adaptive Gain Control according to the principles of the present invention makes use of advances that have been made in the Linear-Domain Adaptive Gain Control Field. A Coded Domain Adaptive Gain Control method and corresponding apparatus are described herein whose performance matches the performance of a corresponding Linear-Domain Adaptive Gain Control (LD-AGC) technique. To accomplish this matching performance, the LD-AGC is used to calculate the desired gain for adaptive gain control. This information is then passed to the Coded Domain Adaptive Gain Control.

Specifically, FIG. 22 is a high level block diagram of the approach taken. In this figure, Adaptive Gain Control is performed on the send-in bit stream, si. The send-in and receive-in bit streams 140*a*, 145*a* are decoded 205*a*, 205*b* into the linear domain, si(n) 210*a* and ri(n) 210*b*, and then passed through a conventional LD-AGC system 305*d* to adjust the level of the si(n) signal 210*a*. Relevant information 225, 215 is extracted from both LD-AGC and the AMR decoding processors 305*d*, 205*a*, and then passed to the coded domain processor 230*e*. The coded domain processor 230*e* modifies the appropriate parameters in the si bit stream 140*a* to effectively adjust its level.

It should be understood that the AMR decoding 205*a*, 205*b* can be a partial decoding of the two signals 140*a*, 145*a*. For example, since LD-AGC is typically concerned with determining signal levels, the post-filter ($H_m(z)$, FIG. 5) present in the AMR decoder 205*a*, 205*b* need not be implemented. It should further be understood that, although the si signal 140*a* is decoded into the linear domain, no intermediate decoding/re-encoding that can degrade the speech quality is being introduced. Rather, the decoded signal 210*a* is used to extract relevant information that aids the coded domain processor 230*e* and is not re-encoded after the LD-AGC processor 305*d*.

Figure 23A:
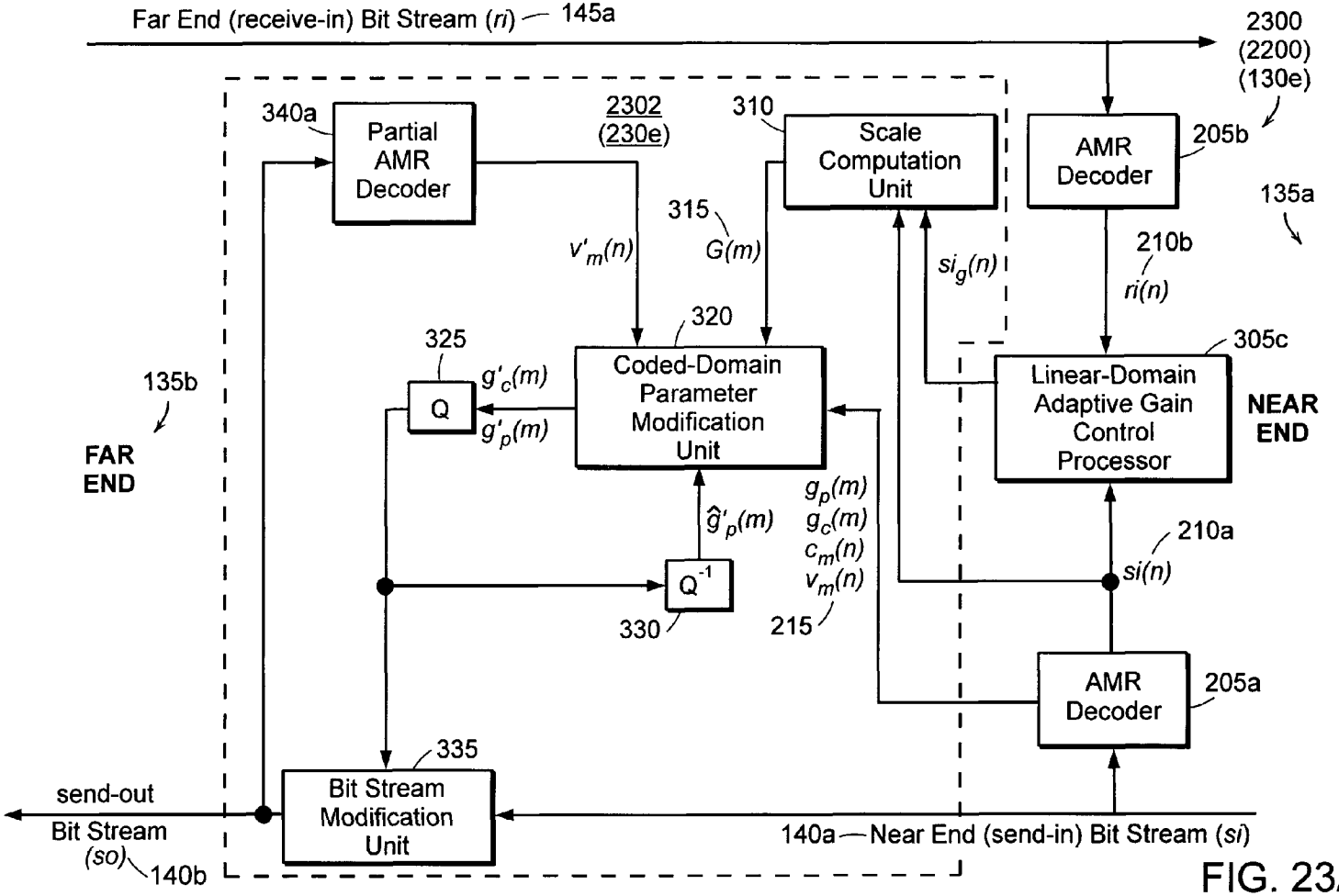
FIG. 23A is detailed block diagram of the CD-AGC system of FIG. 22.

FIG. 23A is a detailed block diagram of an exemplary embodiment of a CD-AGC system 2300 used to implement the CD-AGC systems 130*e* and 2200. Typically, the LD-AGC system 2200 determines an adaptive scaling factor 315 for the signal on a frame by frame basis. Therefore, the problem of Adaptive Gain Control in the coded domain can be considered one of adaptively scaling the signal. The scaling factor 315 for a given frame is determined by the LD-AGC processor 305*d*. The CD-AGC system 2300 includes an exemplary embodiment of a coded domain processor 2302 used to implement the coded domain processor 230*e* of FIG. 22. A "Coded Domain Parameter Modification" unit 320 in FIG. 23A may employ the Joint Codebook Scaling (JCS) method described above. In JCS, both the CELP adaptive codebook gain, $g_p(m)$, and the fixed codebook gain, $g_c(m)$, are scaled.

They are then quantized 325 and inserted 335 in the send-out bit stream, so, 140*b* replacing the original gain parameters present in the si bit stream 140*a*. These scaled gain parameters, when used along with the other decoder parameters 215 in the AMR decoding processor 205*a*, produce a signal that is an adaptively scaled version of the original signal, si(n), 210*a*.

Figure 23B:
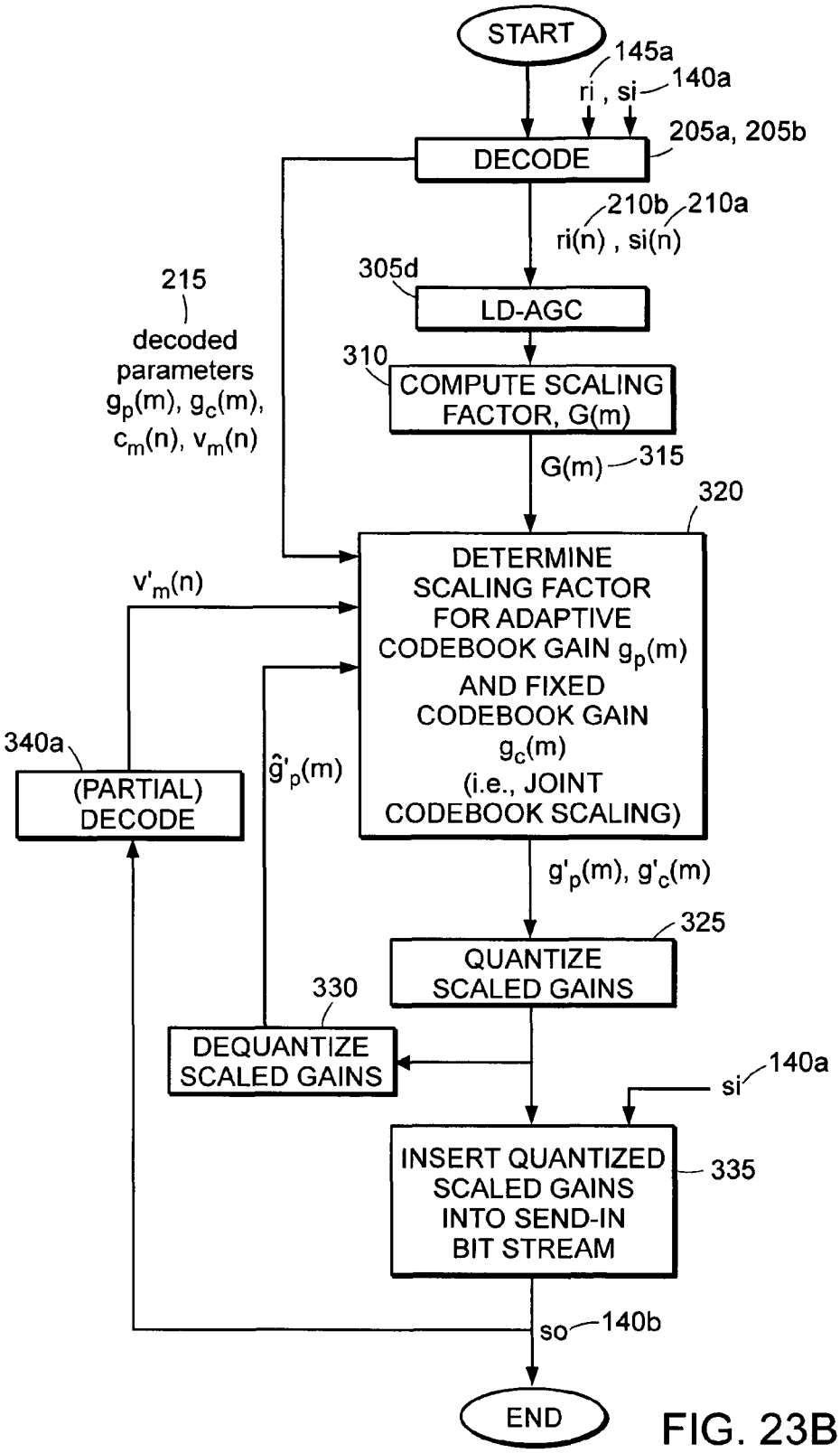
FIG. 23B is a flow diagram corresponding to the CD-AGC system of FIG. 23A.

The operations in the CD-AGC system 2300 shown in FIG. 23A and presented in flow diagram form in FIG. 23B are summarized immediately below:

(i) The receive input signal bit stream ri 145*a* is decoded into the linear domain signal, ri(n), 210*b*.

(ii) The send-in bit stream si 140*a* is decoded into the linear domain signal, si(n), 210*a*.

(iii) A Linear-Domain Adaptive Gain Control system 305*d* that operates on ri(n) 210*b* and si(n) 210*a* is performed. The LD-AGC output is the signal, $si_g(n)$ which represents the send-in signal, si(n), 210*a* after adaptive gain control and may be referred to as the target signal.

(iv) A scale computation 310 that determines the scaling factor 315 between si(n) 210*a* and $si_g(n)$ is performed. A single scaling factor, G(m), 315 is computed for every frame (or subframe) by buffering a frame worth of samples of si(n) 210*a* and $si_v(n)$ and determining the ratio between them. Here, the index, m, is the frame number index. One possible method for computing G(m) 315 is a simple power ratio between the two signals in a given frame. Other methods include computing a ratio of the absolute value of every sample of the two signals in a frame, and then taking a median or average of the sample ratio for the frame, and assigning the result to G(m) 315. The scale factor 315 can be viewed as the factor by which a given frame of si(n) 210*a* has to be scaled to reduce the noise in the signal. The frame duration of the scale computation is equal to the subframe duration of the CELP coder. For example, in the AMR 12.2 kbps coder 205*a*, the subframe duration is 5 msec. The scale computation frame duration is therefore set to 5 msec.

(v) The scaling factor, G(m), 315 is used to determine a scaling factor for both the adaptive codebook gain and the fixed codebook gain parameters of the coder. The Coded-Domain Parameter Modification unit 320 employs the Joint Codebook Scaling method to scale $g_p(m)$ and $g_c(m)$ (vi) The scaled gains are quantized 325 and inserted 335 into the send-out bit stream, so, 140*b* by substituting the original quantized gains in the si bit stream 140*a*.

CD-VQE Distributed About a Network

Figure 24:
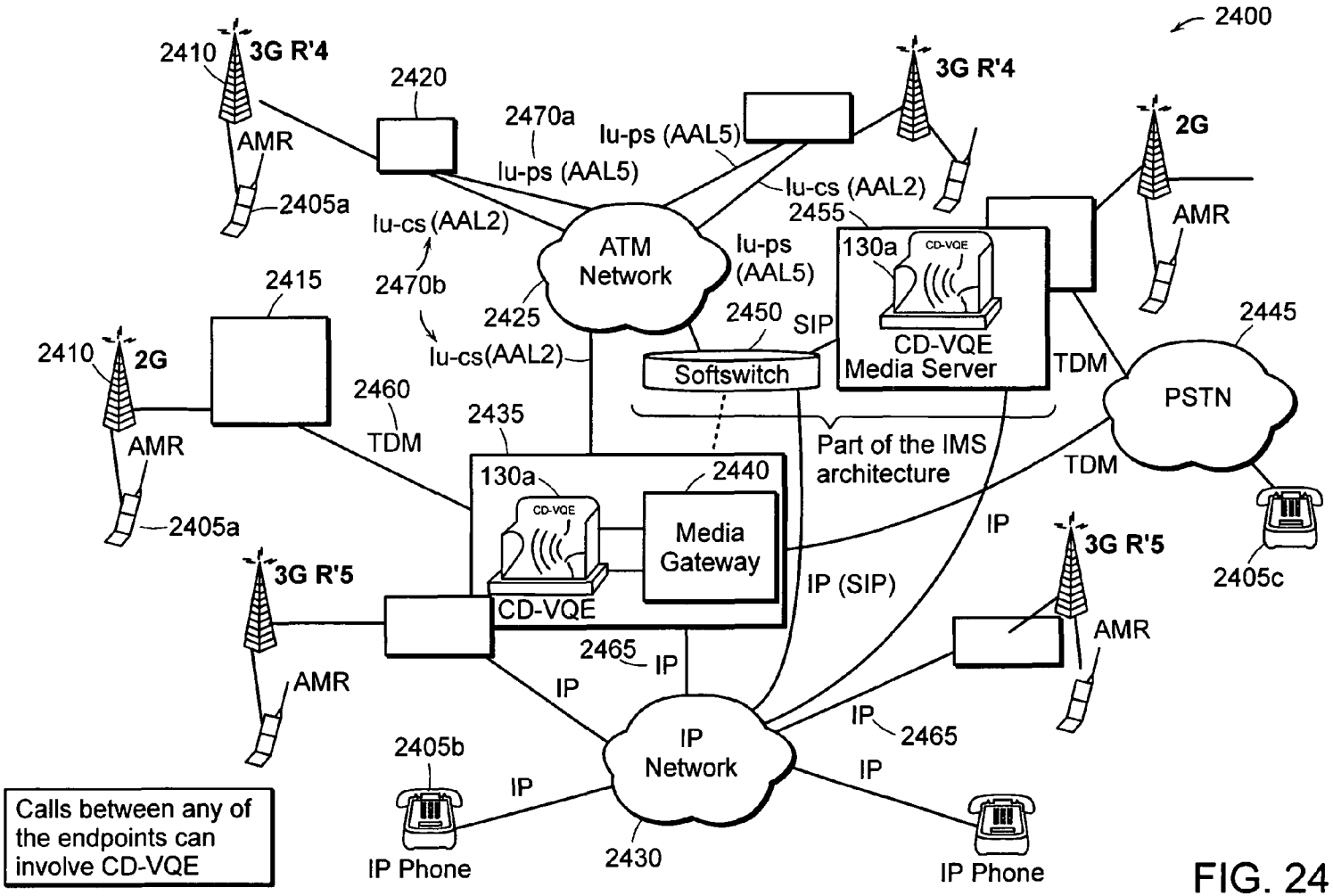
FIG. 24 is a network diagram of a network including Second Generation (2G), Third Generation (3G) networks, VoIP networks, and the CD-VQE system of FIG. 1, or subsets thereof, distributed about the network.

FIG. 24 is a network diagram of an example network 2400 in which the CD-VQE system 130*a*, or subsets thereof, are used in multiple locations such that calls between any endpoints, such as cell phones 2405*a*, IP phones 2405*b*, traditional wire line telephones 2405*c*, personal computers (not shown), and so forth can involve the CD-VQE process(ors) disclosed herein above. The network 2400 includes Second Generation (2G) network elements and Third Generation (3G) network elements, as well as Voice-over-IP (VoIP) network elements.

For example, in the case of a 2G network, the cell phone 2405*a* includes an adaptive multi-rate coder and transmits signals via a wireless interface to a cell tower 2410. The cell tower 2410 is connected to a base station system 2410, which may include a Base Station Controller (BSC) and Transmitter/Receiver Access Unit (TRAU). The base station system 2410 may use Time Division Multiplexing (TDM) signals 2460 to transmit the speech to a media gateway system 2435, which includes a media gateway 2440 and a CD-VQE system 130*a*.

The media gateway system 2435 in this example network 2400 is in communication with an Asynchronous Transfer Mode (ATM) network 2425, Public Switched Telephone Network (PSTN) 2445, and Internet Protocol (IP) network 2430. The media gateway system 2435, for example, converts the TDM signals 2460 received from a 2G network into signals appropriate for communicating with network nodes using the other protocols, such as IP signals 2465, Iu-cs(AAL2) signals 2470*b*, Iu-ps(AAL5) signals 2470*a*, and so forth. The media gateway system 2435 may also be in communication with a softswitch 2450, which communicates through a media server 2455 that includes a CD-VQE 130*a*.

It should be understood that the network 2400 may include various generations of networks, and various protocols within each of the generations, such as 3G-R'4 and 3G-R'5. As described above, the CD-VQE 130*a*, or subsets thereof may be deployed or associated with any of the network nodes that handle coded domain signals. Although endpoints (e.g., phones) in a 3G or 2G network can perform VQE, using the CD-VQE system 130*a*, within the network can improve VQE performance since endpoints have very limited computational resources compared with network based VQE systems. Therefore, more computational intensive VQE algorithms can be implemented on a network based VQE systems as compared to an endpoint. Also, battery life of the endpoints, such as the cellular telephone 2405*a*, can be enhanced because the amount of processing required by the processors described herein tends to use a lot of battery power. Thus, higher performance VQE will be attained by inner network deployment.

For example, the CD-VQE system 130*a*, or subsystems thereof, may be deployed in a media gateway, integrated with a base station at a Radio Network Controller (RNC), deployed in a session border controller, integrated with a router, integrated or alongside a transcoder, deployed in a wireless local loop (either standalone or integrated), integrated into a packet voice processor for Voice-over-Internet Protocol (VoIP) applications, or integrated into a coded domain transcoder. In VoIP applications, the CD-VQE may be deployed in an Integrated Multi-media Server (IMS) and conference bridge applications (e.g., a CD-VQE is supplied to each leg of a conference bridge) to improve announcements.

In a Local Area Network (LAN), the CD-VQE may be deployed in a small scale broadband router, Wireless Maximization (WiMax) system, Wireless Fidelity (WiFi) home base station, or within or adjacent to an enterprise gateway. Using exemplary embodiments of the present invention, the CD-VQE may be used to improve acoustic echo control or non-acoustic echo control, improve error concealment, or improve voice quality.

Although, described in reference to telecommunications services, it should be understood that the principles of the present invention extend beyond telecommunications and to other areas of telecommunications. For example, other exemplary embodiments of the present invention include wideband Adaptive Multi-Rate (AMR) applications, music with wideband AMR video enhancement, or pre-encode music to improve transport, to name a few.

Although described herein as being deployed within a network, other exemplary embodiments of the present invention may also be employed in handsets, VoIP phones, media terminals (e.g., media phone) VQE in mobile phones, or other user interface devices that have signals being communicated in a coded domain. Other areas may also benefit from the principles of the present invention, such as in the case of forcing Tandem Free Operations (TFO) in a 2G network after 3G-to-2G handoff has taken place or in a pure TFO in a 2G network or in a pure 3G network.

Other coded domain VQE applications include (1) improved voice quality inside a Real-time Session Manager (RSM) prior to handoff to Applications Servers (AS)/Media Gateways (MGW); (2) voice quality measurements inside a RSM to enforce Service Level Agreements (SLA's) between different VoIP carriers; (3) many of the VQE applications listed above can be embedded into the RSM for better voice quality enforcement across all carrier handoffs and voice application servers. The CD-VQE may also include applications associated with a multi-protocol session controller (MSC) which can be used to enforce Quality of Service (QoS) policies across a network edge.

It should be understood that the CD-VQE processors or related processors described herein may be implemented in hardware, firmware, software, or combinations thereof. In the case of software, machine-executable instructions may be stored locally on magnetic or optical media (e.g., CD-ROM), in Random Access Memory (RAM), Read-Only Memory (ROM), or other machine readable media. The machine executable instructions may also be stored remotely and downloaded via any suitable network communications paths. The machine-executable instructions are loaded and executed by a processor or multiple processors and applied as described hereinabove.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of modifying an encoded signal, comprising:

modifying at least one parameter value of a current encoded segment of a signal based at least in part on (i) one or more parameters associated with the current encoded segment and (ii) one or more parameters associated with a previous modified encoded segment of the signal, resulting in a corresponding at least one modified parameter value;

replacing the at least one parameter value of the current encoded segment of the signal with the at least one corresponding modified parameter value resulting in a modified current encoded segment of the signal which, in a decoded state, approximates a target enhanced segment associated with the current encoded segment of the signal in at least a partially decoded state; and transmitting the modified current encoded segment.

2. The method according to claim 1, wherein the signal includes a near end speech signal or a combination of a near end speech signal and an echo reflection of one other signal.

3. The method according to claim 2, wherein the one other signal includes a far end speech signal or far end speech and background noise signal.

4. The method according to claim 2, wherein the one other signal includes at least a near end speech signal and, if present, background noise.

5. The method according to claim 1, wherein the signal includes at least a far end speech signal.

6. The method according to claim 1, wherein modifying the at least one parameter value includes at least one of:

adaptively controlling a gain or attenuation of the current encoded segment of the signal in at least a partially decoded state to generate the target enhanced segment;

performing linear domain echo suppression on the current encoded segment of the signal and one other encoded segment of one other signal to generate the target enhanced segment;

adaptively controlling a level of the current encoded segment of the signal in at least a partially decoded state;

reducing noise in the current encoded segment of the signal in at least a partially decoded state to generate the target enhanced segment; or computing the target enhanced segment by cascading at least two of echo suppression module, noise reduction module, adaptive level control module, or adaptive gain module.

7. The method according to claim 1 further including computing a target scale factor that is a function of the target enhanced segment and at least the current encoded segment of the signal in at least a partially decoded state.

8. The method according to claim 7, wherein computing the target scale factor includes computing a square root of a ratio of energies of the target enhanced segment and at least the current encoded segment of the signal or computing a median or average of the ratio of the absolute values of the samples of the target enhanced segment and at least the current encoded segment of the signal in at least a partially decoded state.

9. The method according to claim 1, wherein modifying the at least one parameter value includes modifying a fixed codebook gain parameter and an adaptive codebook gain parameter.

10. The method according to claim 1, wherein modifying the at least one parameter value includes modifying at least one of the following parameters: fixed codebook gain parameter, adaptive codebook gain parameter, fixed codebook vector, pitch lag parameter, fixed codebook vector by encoding the adaptive codebook gain parameter, fixed codebook vector while keeping a pitch lag parameter, or Linear Predictive Coding (LPC) filter parameters.

11. The method according to claim 1, wherein the current encoded segment and modified current encoded segment of the signal are Code Excited Linear Prediction (CELP) encoded segments.

12. The method according to claim 1 further including calculating a modified adaptive codebook gain.

13. The method according to claim 12 wherein calculating a modified adaptive codebook gain includes:

(i) computing a target scale factor that is a function of the target enhanced segment and at least the current encoded segment of the signal in at least a partially decoded state;

(ii) computing an adaptive codebook scale factor that is equal to the target scale factor multiplied by a square root of a ratio of (a) energy of an adaptive codebook vector corresponding to the current encoded segment of the signal to (b) energy of an adaptive codebook vector corresponding to the previous modified encoded segment of the signal;

(iii) multiplying the adaptive codebook scale factor by an adaptive codebook gain value resulting in the modified, adaptive codebook gain value; and (iv) quantizing the modified, adaptive codebook gain resulting in a quantized, modified, adaptive codebook, gain value; and wherein replacing the at least one parameter includes replacing the adaptive codebook gain value in an encoded state with the quantized, modified, adaptive codebook, gain value.

14. The method according to claim 1 further including calculating a modified fixed codebook gain value.

15. The method according to claim 14 wherein calculating the modified fixed codebook gain value includes:

(i) computing a target scale factor that is a function of the target enhanced segment and at least the current encoded segment in at least a partially decoded state;

(ii) calculating roots of an equation obtained by equating (a) energy of excitation of the current encoded segment multiplied by the target scale factor squared to (b) energy of excitation of the previous modified encoded segment;

(iii) (A) assigning a fixed codebook scale factor to the ratio of a value of a real, positive root of the equation, if it exists, to the fixed codebook gain parameter in a decoded state or (B) assigning the fixed codebook scale factor to zero if it does not exist and (1) calculating an adaptive codebook scale factor to be the target scale factor multiplied by the square root of a ratio of (a) energy of excitation of the current encoded segment to (b) energy of the adaptive codebook vector of the previous modified encoded segment, (2) multiplying the adaptive codebook scale factor by an adaptive codebook gain in a decoded state resulting in a modified, adaptive codebook gain, and (3) quantizing the modified, adaptive codebook gain resulting in a quantized, modified, adaptive codebook, gain parameter;

(iv) multiplying the fixed codebook scale factor by a fixed codebook gain parameter in a decoded state resulting in a modified, fixed codebook gain;

(v) quantizing the modified, fixed codebook gain resulting in a quantized, modified, fixed codebook, gain parameter; and wherein replacing the at least one parameter includes (a) replacing a fixed codebook gain parameter in an encoded state with the quantized, modified, fixed codebook, gain parameter, and, if a value of a real positive root of the equation does not exist, (b) replacing an adaptive codebook gain parameter in an encoded state with the quantized, modified, adaptive codebook, gain parameter.

16. The method according to claim 1 used for voice quality enhancement.

17. The method according to claim 1 further including:

comparing a metric of the current encoded segment in at least a partially decoded state against a threshold;

in an event the metric is above the threshold, modifying the adaptive codebook gain parameter and the fixed codebook gain parameter; and in an event the metric is below the threshold, modifying an adaptive codebook gain parameter, fixed codebook gain parameter, and fixed codebook vector.

18. The method of claim 1 further including determining the target enhanced segment as a function of the current encoded segment and one other encoded segment in at least a partially decoded state.

19. The method of claim 1 further including replacing the at least one parameter of the current encoded segment with the at least one modified parameter resulting in the modified current encoded segment which, in a decoded state, the modified current encoded segment approximates background noise in at least one previous frame of the signal in a decoded state.

20. The method according to claim 19, wherein modifying the at least one parameter causes the modified current encoded segment, in a decoded state, to spectrally match the background noise of the current encoded segment in a decoded state.

21. The method according to claim 19 further including estimating background noise during segments of the signal in at least a partially decoded state identified as background noise.

22. The method according to claim 21 wherein the estimating is a function of the at least one parameter of the current encoded segment.

23. The method according to claim 21 wherein estimating occurs during segments of the signal in at least a partially decoded state that are substantially free of speech and echoes.

24. The method according to claim 19 further including selectively passing the at least one modified parameter in an encoded state that approximates background noise in the current encoded segment in a decoded state or at least one modified parameter in an encoded state that is produced by at least one voice quality enhancement process.

25. The method according to claim 24 further including determining whether linear domain acoustic echo suppression heavily suppresses the linear domain signal in at least a partially decoded state and, if so, includes selectively passing the at least one modified parameter in an encoded state that approximates background noise in the current encoded segment in a decoded state.

26. An apparatus for modifying an encoded signal, comprising:

a decoder configured to at least partially decode a current segment of a signal into a corresponding linear domain segment in at least a partially decoded state and decode at least one encoded parameter of the current segment resulting in a corresponding at least one parameter in a decoded state;

a linear domain processor configured to generate a target enhanced segment as a function of the current encoded segment in at least a partially decoded state;

a coded domain processor configured to:

modify the at least one parameter in a decoded state based at least in part on (i) one or more parameters associated with the current encoded segment and (ii) one or more parameters associated with a previous modified encoded segment of the signal, resulting in a corresponding at least one modified parameter, replace the at least one encoded parameter of the current encoded segment with the at least one modified parameter in an encoded state resulting in a modified current encoded segment of the signal, which, when decoded, approximates the target enhanced segment, and transmit the modified current encoded segment.

27. The apparatus according to claim 26 wherein the signal includes at least a near end speech signal.

28. The apparatus according to claim 26 further including a second decoder configured to at least partially decode one other encoded segment of one other signal into a corresponding linear domain segment in at least a partially decoded state, the linear domain processor being configured to generate the target enhanced segment as a function of the current encoded segment and the one other encoded segment in at least a partially decoded state, the one other signal including at least far end speech and, if present, background noise signal.

29. The apparatus according to claim 28 wherein the signal includes at least a far end speech signal.

30. The apparatus according to claim 20, wherein the one other signal includes at least a near end speech and, if present, background noise signal.

31. The apparatus according to claim 26 wherein the linear domain processor includes a linear domain adaptive gain control unit that calculates a target scale factor as a function of the first encoded signal current encoded segment in at least a partially decoded state.

32. The apparatus according to claim 26, wherein the coded domain processor includes a scale computation unit that calculates a target scale factor as a function of the target enhanced segment and at least the current encoded segment in a partially decoded state.

33. The apparatus according to claim 26, wherein the scale computation unit calculates the target scale factor by computing a square root of a ratio of energies of the target enhanced segment and at least the current encoded segment in at least a partially decoded state or computing a median or average of the ratio of the absolute values of samples of the target enhanced segment and at least the current encoded segment in at least a partially decoded state.

34. The apparatus according to claim 26 wherein the at least one modified parameter includes a fixed codebook gain parameter and an adaptive codebook gain parameter.

35. The apparatus according to claim 26 wherein the at least one modified parameter includes at least one of the following parameters: fixed codebook gain parameter, adaptive codebook gain parameter, fixed codebook vector, pitch lag parameter, or Linear Predictive Coding (LPC) filter parameters.

36. The apparatus according to claim 26 wherein the current encoded segment is a Code Excited Linear Prediction (CELP) encoded segment.

37. The apparatus according to claim 26 wherein, the decoder is a first decoder and wherein the coded domain processor further includes:

a scale computation unit that calculates a target scale factor as a function of the target enhanced segment and at least the current encoded segment in a partially decoded state;

a second decoder configured to at least partially decode the previous modified encoded segment and outputting at least one adaptive codebook vector; and a coded domain parameter modification unit that computes the at least one modified parameter as a function of the target scale factor, at least one decoded parameter, at least one adaptive codebook vector, and at least one modified parameter.

38. The apparatus according to claim 26 wherein the coded domain processor calculates an adaptive codebook gain.

39. The apparatus according to claim 38 wherein, to calculate the adaptive codebook gain, the coded domain processor:

(i) computes a target scale factor that is a function of the target enhanced segment and at least the current encoded segment in at least a partially decoded state;

(ii) computes an adaptive codebook scale factor that is equal to the target scale factor multiplied by a square root of a ratio of (a) energy of an adaptive codebook vector corresponding to the current encoded segment to (b) energy of an adaptive codebook vector corresponding to the previous modified encoded segment of the signal;

(iii) multiplies the adaptive codebook scale factor by an adaptive codebook gain resulting in a modified, adaptive codebook gain;

(iv) quantizes the modified adaptive codebook gain resulting in a quantized, modified, adaptive codebook, gain parameter; and (v) replaces an adaptive codebook, gain parameter in an encoded state with the quantized, modified, adaptive codebook, gain parameter.

40. The apparatus according to claim 26 wherein the coded domain processor calculates a fixed codebook gain.

41. The apparatus according to claim 40 wherein to calculate the fixed codebook gain, the coded domain processor:

(i) computes a target scale factor that is a function of the target enhanced segment and at least the current encoded segment in at least a partially decoded state;

(ii) calculates roots of an equation obtained by equating (a) energy of excitation of the current encoded segment multiplied by the target scale factor squared to (b) energy of excitation of the previous modified encoded segment;

(iii) assigns a fixed codebook scale factor to the ratio of a value of a real, positive root of the equation, if it exists, to the fixed codebook gain parameter in a decoded state, or assigns the fixed codebook scale factor to zero if it does not exist and (a) calculates an adaptive codebook scale factor to be the target scale factor multiplied by the square root of a ratio of (1) energy of excitation of the current encoded segment to (2) energy of the adaptive codebook vector of the previous modified encoded segment (b) multiplies the adaptive codebook scale factor by an adaptive codebook gain resulting in a modified, adaptive codebook gain, and (c) quantizes the modified, adaptive codebook, gain resulting in a quantized, modified, adaptive codebook, gain parameter;

(iv) multiplies the fixed codebook scale factor by a fixed codebook gain parameter in a decoded state resulting in a modified, fixed, codebook gain;

(v) quantizes the modified, fixed codebook gain resulting in a quantized, modified, fixed codebook, gain parameter; and (vi) (a) replaces a fixed codebook gain parameter in an encoded state with the quantized, modified, fixed codebook, gain parameter, and, if a value of a real positive root of the equation does not exist, (b) replaces an adaptive codebook gain parameter in an encoded state with the quantized, modified, adaptive codebook, gain parameter.

42. The apparatus according to claim 26 used in a voice quality enhancer.

43. The apparatus according to claim 26 implemented in at least one of the following forms: software executed by a processor, firmware, or hardware.

44. The apparatus according to claim 26 configured to process signals originated by adaptive multirate (AMR) coders.

* * * * *

UNITED STATES PATENT AND TRADEMARK OFFICE

CERTIFICATE OF CORRECTION

PATENT NO. : 8,874,437 B2
APPLICATION NO. : 11/165599
DATED : October 28, 2014
INVENTOR(S) : Rafid A. Sukkar, Richard C. Younce and Peng Zhang It is certified that error appears in the above-identified patent and that said Letters Patent is hereby corrected as shown below:

In the Claims

Column 26, Claim 30, line 63, please delete "20" and insert --28--

Column 27, Claim 31, line 2, please delete "first encoded signal"

Signed and Sealed this
Seventeenth Day of February, 2015

Michelle K. Lee

Michelle K. Lee
*Deputy Director of the United States Patent and Trademark Office*